United States Patent [19]

Nakajima et al.

[11] Patent Number: 4,636,963

[45] Date of Patent: Jan. 13, 1987

[54] CONTROL SYSTEM FOR AN AUTOMATIC VENDING MACHINE

[75] Inventors: Yo Nakajima; Yoshihisa Nakajima; Yoshio Ushijima, all of Nagano, Japan

[73] Assignee: Fuji Electric Co., Ltd., Kanagawa, Japan

[21] Appl. No.: 838,411

[22] Filed: Mar. 7, 1986

Related U.S. Application Data

[63] Continuation of Ser. No. 537,285, Sep. 29, 1983, abandoned.

[30] Foreign Application Priority Data

Sep. 29, 1982 [JP] Japan ..... 57-170666

[51] Int. Cl.[4] ..... G07D 1/06; G07F 11/00

[52] U.S. Cl. ..... 364/479; 364/146; 340/706; 340/825.35; 221/9

[58] Field of Search ..... 364/479, 712, 146; 221/2, 9, 14; 194/1 N, 1 M, DIG. 3; 340/706, 712, 825.35

[56] References Cited

U.S. PATENT DOCUMENTS

| | | | |
|---|---|---|---|
| 4,185,281 | 1/1980 | Silverstone | 340/706 |
| 4,231,105 | 10/1980 | Schuller et al. | 364/900 |
| 4,280,181 | 7/1981 | Levasseur | 364/479 |
| 4,282,575 | 8/1981 | Hoskinson | 364/479 |
| 4,316,532 | 2/1982 | Levasseur | 194/1 N |
| 4,347,925 | 9/1982 | Sugimoto et al. | 194/1 N |
| 4,350,238 | 9/1982 | Shah et al. | 364/479 |
| 4,372,464 | 2/1983 | Otten | 194/10 |
| 4,376,479 | 3/1983 | Sugimoto et al. | 194/1 N |
| 4,381,835 | 5/1983 | Shah et al. | 364/479 |
| 4,392,564 | 7/1983 | Hayashi | 194/1 N |
| 4,438,326 | 3/1984 | Uchida | 364/900 |
| 4,463,446 | 7/1984 | Shah et al. | 340/825.35 |
| 4,481,508 | 11/1984 | Kamei et al. | 340/712 |

*Primary Examiner*—Jerry Smith
*Assistant Examiner*—Allen MacDonald
*Attorney, Agent, or Firm*—Brumbaugh, Graves, Donohue & Raymond

[57] ABSTRACT

A control system for an automatic vending machine is adapted to set operating parameters such as the selling prices of various commodities. The system includes a microprocessor, associated memory, push-button switches, displays and a control program. For setting the price of a particular commodity the system responds to repeated actuation of certain switches and sequentially increments the values of a particular operating parameter stored in memory and displayed on the display, so that the value of a particular operating parameter can be changed without directly inputting data representing the desired value of the parameter. The operating mode of the machine is changed in a similar manner. The system reduces the number of switches required to change parameter values.

1 Claim, 25 Drawing Figures

CONTROL SYSTEM FOR AN AUTOMATIC VENDING MACHINE

This application is a continuation of application Ser. No. 537,285, filed on Sept. 29, 1983, abandoned.

BACKGROUND OF THE INVENTION

This invention relates to a control device for an automatic vending machine, and more specifically to a control device for an automatic vending machine adapted to perform selling operations while setting the selling prices of commodities to be sold into non-volatile memory means such as a magnetic memory or a semiconductor memory backed-up with an electric cell or the like.

Known price setters for automatic vending machines include those having digital switches disposed for setting every selling price or every selling column, or having ten data input or function keys for non-volatile memory means to perform setting of every selling price or selling column. Further, in the automatic vending machine, a coin-processing section for judging the authenticity of deposited coins, calculating the sum of the deposited money, judging the possibility for the sale by comparing the sum of the deposited money and the set selling price of the chosen commodity to issue a "sale possible" signal, and discharging the difference between the sum of the deposited money and the value of the sold commodity as a balance is collected in one unit (hereinafter referred as a coin meck), and the outer dimension and the signal transmission system thereof are standardized. Thus, since the price setter is large, when it is located in the coin meck it cannot be operated from the front of the coin meck in view of the dimensional restriction. That is, since the price setter is disposed within the coin meck, a coin selector has to be removed when setting the prices. Furthermore, in the machines which use ten keys, although various settings and selling operation changes have been made by function keys, the operability is poor possibly leading to misoperation.

SUMMARY OF THE INVENTION

The object of this invention is to provide a control device for an automatic vending machine having a price setter which is more compact and dependable.

In accordance with the invention a control system for an automatic vending machine is adapted to set values of operating parameters such as selling prices of various commodities in memory means. The system comprises mode switch and control means for selecting an operational mode of the machine depending on the number of mode switch actuations, first memory means for storing data indicating the operational mode of the machine, first display means for displaying the machine operational mode based on the content of said first memory means, column switch and control means for selecting the operating parameter to be set in dependence on the number of column switch actuations when said operational mode is selected by said mode switch means, second memory means for storing data representing the parameters to be set, second display means for displaying the particular parameter being set based on the content of said second memory means, third memory means for storing data representing a number of possible values for the particular parameter being set, data switch and control means for changing the content stored in said third memory means in response to the number of said data switch actuations to thereby adjust and set the value of the particular parameter, and third display means for displaying data representative of the content stored in said third memory means.

Preferably, the system comprises a microprocessor with peripheral manually actuable switches and displays, associated memory and a control program stored in the memory. The control program will cause the display to sequentially display a number of different possible values for the particular parameters in response to repeated actuation of the corresponding switches. Thus, if an operator desires a particular parameter, such as the selling price of a particular commodity, to have a value of "50" for example, various numbers will be displayed in sequence in respons to repeated actuation of a corresponding switch for that particular parameter. When the desired value is reached, the operator should stop actuating that particular switch and then actuate another switch which will cause the control program to set the displayed value as the value of the particular parameter. Other parameters are set in the same manner, i.e., by sequential display of a number of possible values in response to repeated switch actuations. Preferably a data switch is provided for each digit to set the value of the particular parameter.

Other objects and advantages will become apparent from the following detailed description of one embodiment, the appended claims and the accompanying drawings.

DETAILED DESCRIPTION OF THE PREFERRED EMBODIMENT

Figure 1:
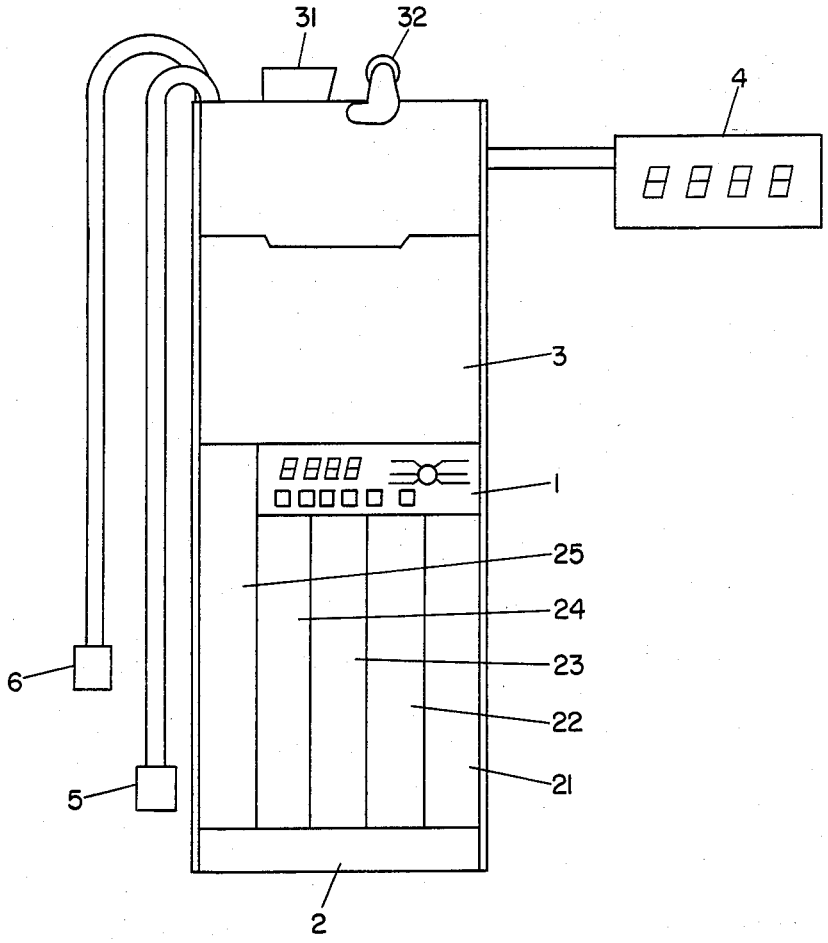
FIG. 1 is an outer front view of a coin meck as one embodiment according to this invention.

FIG. 1 shows a front view of a coin meck according to an embodiment of the invention. In FIG. 1, a coin selecting device 3 judges the authenticity of coins deposited in a coin inlet 31 and classifies authentic coins depending on the denomination thereof to output a coin signal. A change discharging device 2 comprises change cylinders 21, 22, 23, 24, 25, etc. which contain automatically supplied coins classified by the coin selecting device 3 or manually supplied coins, change check switches (not shown) which detect whether the amount of coins are contained in each of the change cylinders exceed a predetermined number, and a discharge mechanism (not shown) which discharges the coins one by one contained in the change cylinders and the like. Sub-change cylinder 21 manually supplies certain denominations of coins (hereinafter referred to as Sub1), and change cylinders 22, 23, 24 automatically or manually supply different coin denominations and sub-change cylinder 25 also manually supplies certain denominations of coins (hereinafter referred to as Sub2). A slug chute, for receiving coins detected as unauthentic by the coin selecting device 3, is provided in front of the change cylinder 25, and another change cylinder for automatically supplying a certain denomination of coins is provided at the back of the change cylinder 25. A 4 digit, 7 segment LED (light emitting diode) display 4 for displaying the amount of money deposited is mounted at such a position that a customer can be informed of the amount of deposited money from outside the automatic vending machine. An electrical connector 5 is connected to the main body of the automatic vending machine for delivering selected commodities based on the commodity selected and on the "sale possible" signal outputted from the coin meck, and electrical connector 6 is for connection to a bill (paper money) distinguishing device. An operation panel 1 is provided for changing the operation mode of the coin meck, such as setting of the selling price or the like and recovery of change. A return roller 32 is depressed downwardly when a customer actuates a return layer to demand the return of deposited money, whereupon a return money signal is issued from the coin selecting device 3.

Figure 2:
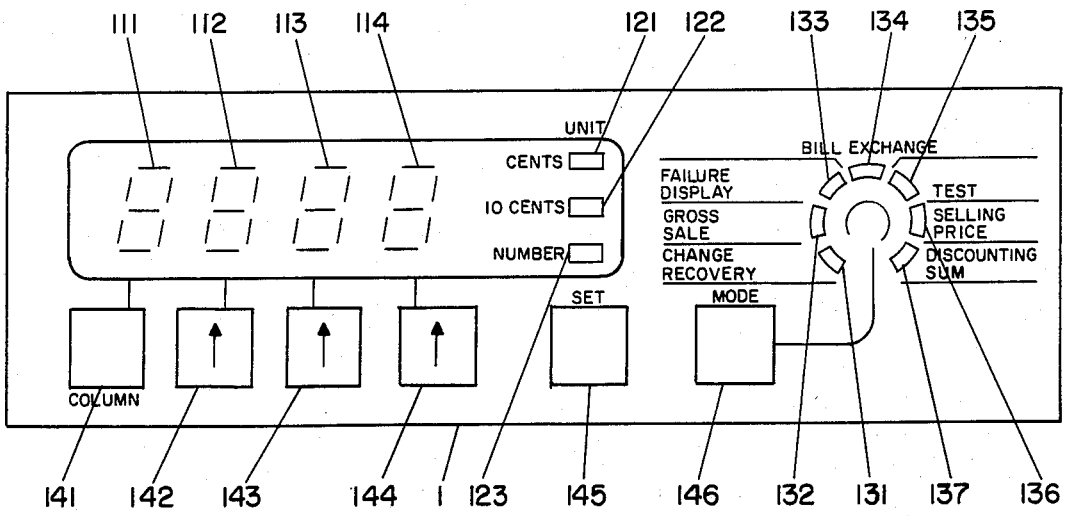
FIG. 2 is an enlarged view of the operation panel shown in FIG. 1.

FIG. 2 is an enlarged view of the operation panel 1 shown in FIG. 1. In FIG. 2, 111, 112, 113, 114 represent 7 segment LED displays for confirming the data upon setting of prices or the like. Unit LED displays 121, 122 and 123 are provided for indicating the unit of the data displayed on the 7 segment LEDs 111, 112, 113, 114, and indicate the particular units of money displayed on the 7 segment displays. Mode LEDs 131, 132, 133, 134, 135, 136, 137 are provided indicating the operation mode of the coin meck. These LEDs indicate the change recovery mode for recovering the coins contained in the change cylinder 21 and the like when the mode LED 131 is lit, the gross sales display mode for displaying the gross sale sum when the mode LED 132 is lit, and the failure display mode for displaying the failed (abnormal) machine section by code when the mode LED 133 is lit. When LED 134 is lit, the display is in the setting mode for setting the limit of the continuous sale amount. The number of temporarily reservable bills in the bill distinguishing device and for setting if the deposited bill should be exchanged for coins and returned is displayed when the mode LED 134 is lit.

Further, the display is in the selling test mode for enabling the selling of selected commodities even if no coin is displayed when the mode LED 135 is lit, in the selling price setting mode for setting the selling price when the mode LED 136 is lit, in the discounting sum setting mode for setting the discounting sum where the continuous sale quantity arrives at the restricted sale quantity when the mode LED 137 is lit, and in the usual selling mode when none of LEDs 131–137 is lit.

Push-button switch 141 is a column switch for selecting the setting column of the selling price and other kinds of data, switches 142, 143, and 144 are data switches for stepping the data (numerical values) to change each digit displayed on the 7 segment LEDs 112, 113, 114 respectively, switch 145 is a setting switch which when pushed sets the data displayed on the 7 segment LEDs 112, 113, 114 into the column displayed on the LED 111, and switch 146 is a mode switch for selecting the operational mode.

Figure 3:
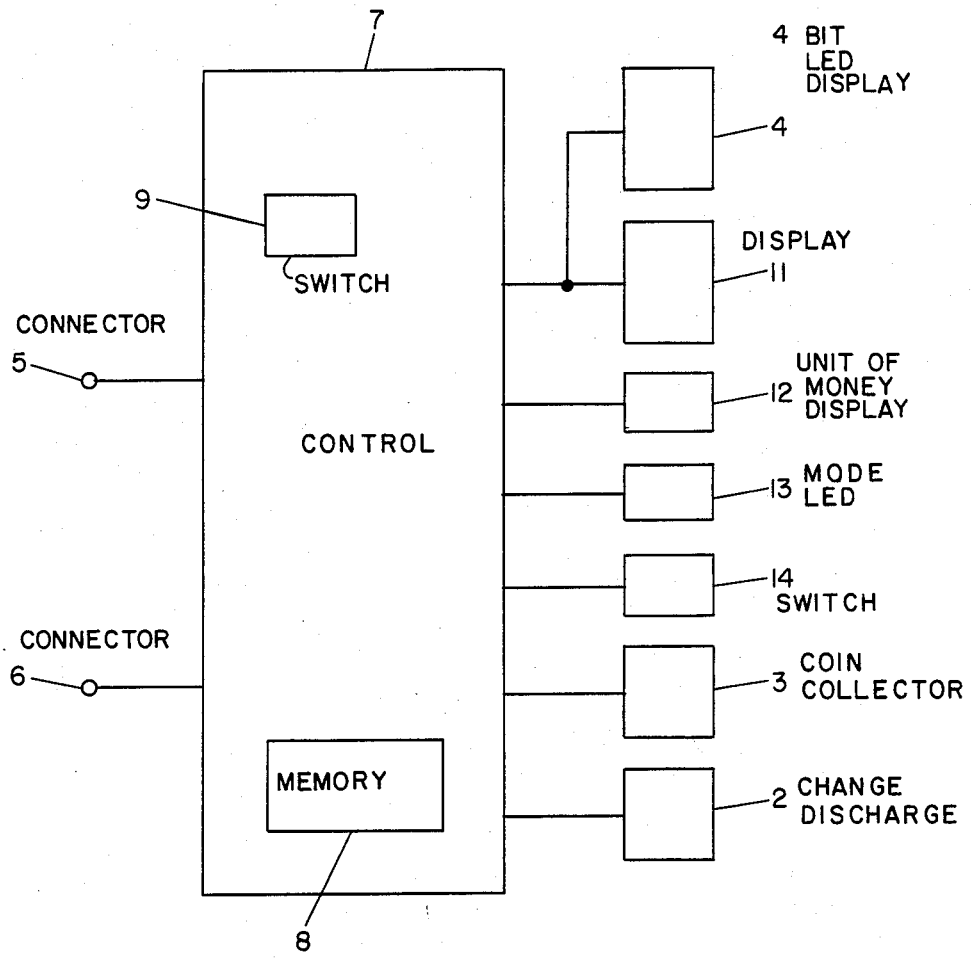
FIG. 3 is a block diagram showing the structure of the embodiment.

FIG. 3 is a block diagram showing the schematic constitution of the coin meck of the embodiment, in which the same numerals as those in FIG. 1. represent the same portions. A control device 7 for controlling the entire coin meck comprises a microcomputer (not shown), a non-volatile memory 8 composed of C-MOS-RAM whose power source is backed-up by an electric cell or an electric double layer capacitor (a capacitor generally referred to as a super capacitor having a great capacitance and with very low leaking current), a 2-bit DIP switch 9 for designating whether the coins contained in the manually supplying change cylinder 21, 25 are of certain respective denominations are both mounted on a printed circuit board and disposed at the back of the coin selecting device 3 and the change cylinders 21–25. Display 11 is composed of the 4-digit LED, that is, the 7 segment LEDs 111, 112, 113, 114 shown in FIG. 2. The 4-digit LED 4 is connected in parallel with a LED 11 and performs the same display as that on the LED 11. LED unit 12 is composed of the unit LEDs 121, 122, 123 for displaying the unit of money displayed, LED 13 represents a mode LED composed of the mode LEDs 131, 132, 133, 134, 135, 136, 137 for displaying the operation mode, and 14 is a push-button switch composed of push-button switches 141, 142, 143, 144, 145, 146. LED 4, LED 11, unit LED 12, mode LED 13, push-button switch 14, coin selecting device 3, change discharge device 2, connector 5 and connector 6 are all connected to the control device 7.

Figure 17:
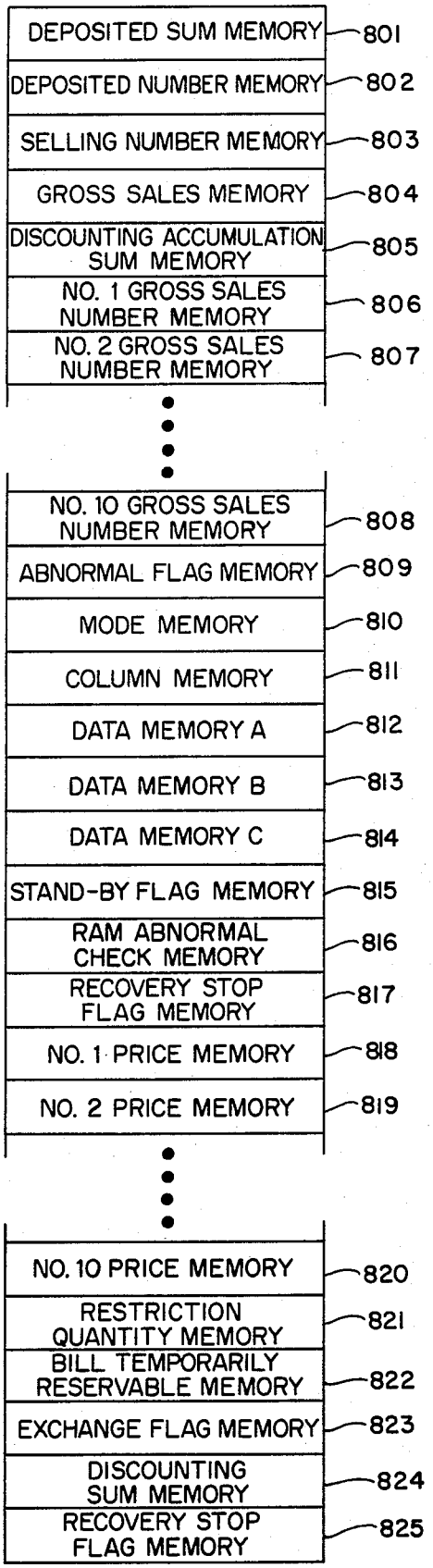
FIG. 17 is a RAM map showing the main data stored in RAM memory of the embodiment.

FIG. 17 is a RAM map showing the main data stored in the C-MOS-RAM indicated in FIG. 3, wherein the data to be stored (excepting flags) are stored in the BCD form and a required number of digits is allocated. The number of price columns is shown as 10.

The signal transmission between the control device 7 and the automatic vending machine main body (not shown) by way of the connector 5 is carried out by the system described in Japanese Patent Publication No. 44239/1979. Specifically, the system uses a commodity sale signal ("sale possible" signal) issued from the coin counting device (coin meck) to the automatic vending machine main body upon authorization of the sale for a commodity, a commodity selling signal issued from the automatic vending machine main body when dispensing the commodity upon receiving the commodity sale signal from the automatic vending machine main body (sale start signal), and a sale selection signal showing the commodity that has been selected. The commodity sale signal is instantly eliminated with the commodity selling signal and the sale selection signal is formed with a signal formed by delaying the commodity selling signal by a predetermined period to thereby transmit the commodity sale signal and the sale selection signal on a common signal line.

The operation of the embodiment will now be explained referring to flow charts shown in FIG. 4–FIG. 16 and display examples on the LED 11 and the unit LED 12 shown in FIG. 18–FIG. 25. In FIG. 4 through FIG. 16, connection terminal points represented by the same symbols A-P are connected to each other.

1. Operation for Changing the Operation Mode

Figures 4, 5:
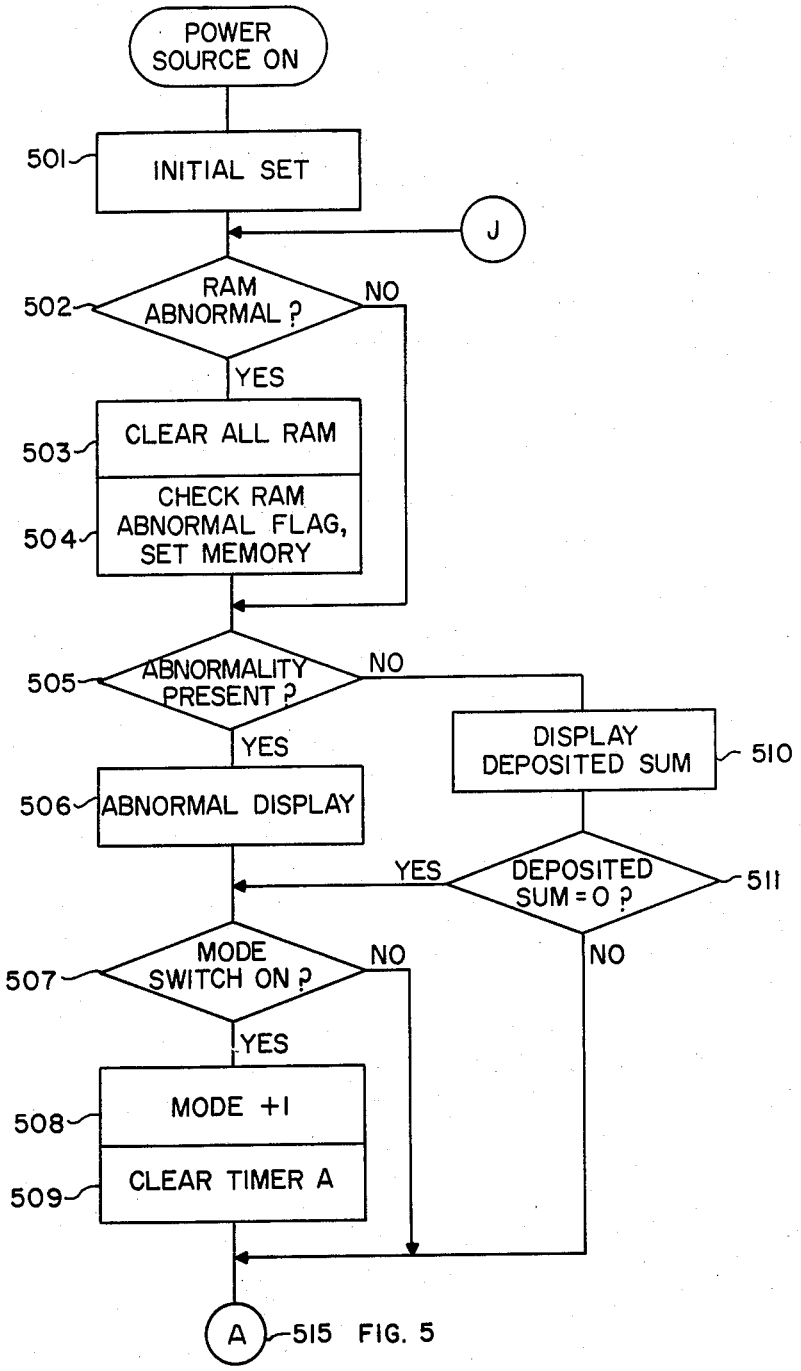
FIGS. 4–16 are flow charts showing the operation of the embodiment.
Figure 5:
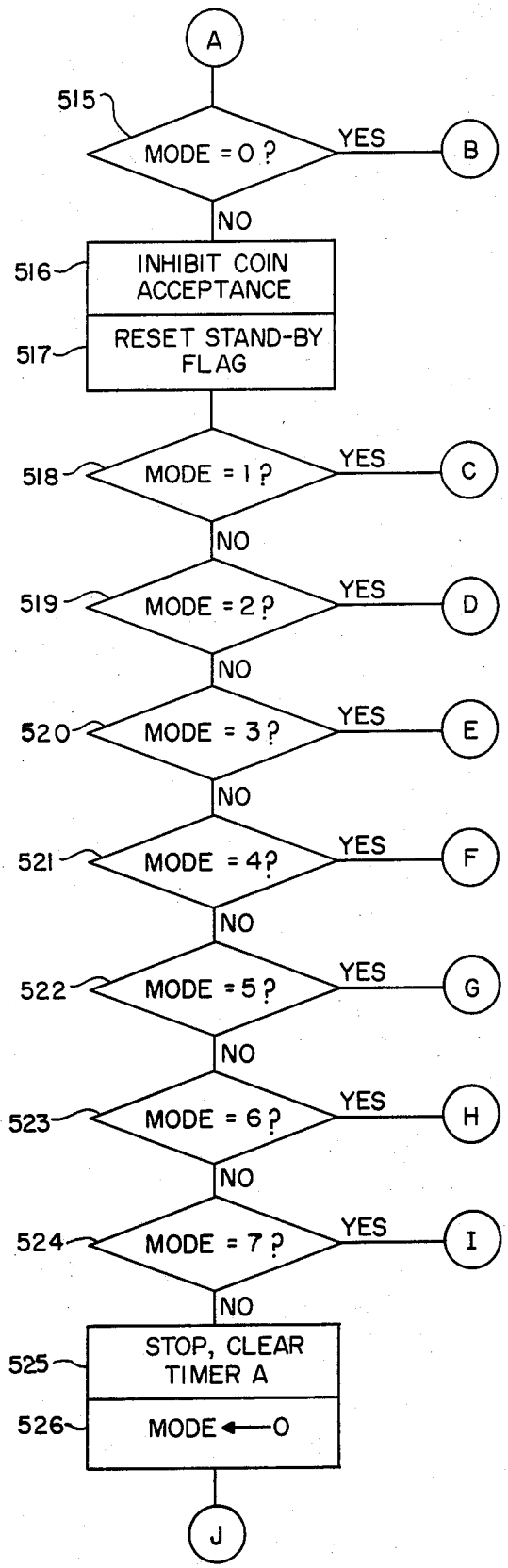

The operation mode comprises various types of modes as described later. Since the gross sales (erroneous change discharge) is liable to be performed in the case when the set price is altered or erroneous change recovery is carried out during the selling operation, it is necessary to restrict the possible case of changing the operation mode. FIG. 4 more particularly shows the operation for changing the operation mode.

In FIG. 4, upon supply of a main power source at the terminal 500, an initial setting is made at the step 501 including turning off of all of the displays on the LED 4 and inhibiting the acceptance of coins by outputting a signal to the coin selecting device 3 and the bill distinguishing device. At the next step 502, an abnormality check is performed to determine whether the data stored in C-MOS-RAM 8 may be incorrect due to a decrease in the voltage of a backup power source during interruption of the main power source, (see FIG. 17). Specifically, an arbitrary 8 bit number is stored in abnormality check memory 816, and is checked to see whether it has changed. The program goes to step 503 if there is abnormality but goes to step 505 if no abnormality is detected. The entire contents in C-MOS-RAM 8 are cleared at the step 503. In step 504, a predetermined 8 bit arbitrary number (for instance "10101010") is written into the abnormal check memory and a predetermined abnormal flag is set in the abnormal flag memory 809 in the RAM 8 to indicate the generation of an abnormality. At the next step 505, it is determined whether an abnormality flag is stored in the abnormal flag memory 809. If no abnormality flag is stored, the program goes to step 510, but if an abnormality flag is stored, the program goes to step 506.

Figure 18:
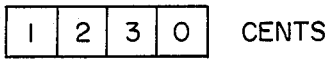
FIGS. 18–25 are charts showing a display example on the display means.
Figure 19:
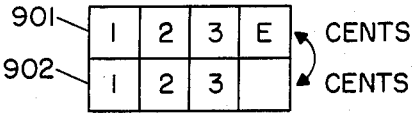

At step 510, the sum of deposited money is displayed on the LED 11 and the unit LED 12 as shown in FIG. 18, and then the program proceeds to step 511. FIG. 18 shows the case where 1230 units of money were deposited. At step 506, the generation of an abnormality is displayed as shown in FIG. 19 where a flickering "E" is displayed for a predetermined time interval on the LED 144 as the least significant digit of the sum of deposited money. The least significant digit is displayed as 0 when there is no abnormality. The flickering "E" display is carried out at step 506 by a timer which is initially set to a value and then decremented and checked on every passage through the step 506 in the loop to see whether the time has elapsed.

At step 511, it is determined whether the value stored in the deposited money memory 801 is zero or not. The program then goes to step 507 if it is zero, and to step 515 in FIG. 5 if it is not zero. The program goes from step 507 to step 508 upon turning ON of the mode switch 156, but goes to step 515 shown in FIG. 5 if this is not the case. The time at which the mode switch 146 is turned ON (not the state it is kept ON) can be detected by comparing the present state of the mode switch (ON or OFF) on every passage through the step 507 in the loop with the state the switch was in at the previous time through the loop. It is assumed hereinafter that the timing is always detected at the time when push-button switch 14 is first turned ON.

At step 508, "1" is added to the operation mode value stored in the mode memory 810 in the RAM 8 to change the operation mode. The program then goes to step 509, where the content counted in the timer A as described below is cleared (but not stopped). The program then goes to step 515 shown in FIG. 5.

As described above, changing the operation mode by the depression of the mode switch 146 is enabled only when the sum of deposited money is zero or when an abnormality is generated to thereby prevent misoperation. Further, "1" is added to the value in the mode memory on every depression of the mode switch 146 when the sum of deposited money is zero or an abnormality is generated.

2. Operation for Selecting Each of the Operation Modes

FIG. 5 shows the operation for selecting each of the operation modes in accordance with the content in the mode memory 810. Specifically, at the step 515, it is determined whether the content of mode memory 810 (hereinafter referred to as the mode) is zero or not. The program proceeds to FIG. 6 if it is zero, but to step 516 if it not zero. At 516, a signal for inhibiting the acceptance of coins is issued to the coin selecting device 3 and the bill distinguishing device is generated before going to step 516. At step 516, a stand-by flag 815 indicating that the coin meck is in the stand-by state is reset.

At the steps 518–524, it is determined what the present mode is among the modes 1–7, and then the program goes to that predetermined mode. If the mode does not correspond to any of the modes 0–7, the timer A described below is stopped and the counted content is cleared at the step 525. Next, at step 526, the mode memory 810 is reset to zero after which the program returns to step 502.

In this case, mode zero shows a normal selling mode, mode 1 shows a change recovery mode, mode 2 shows a gross sales display mode, mode 3 shows a failure display mode, mode 4 shows the mode for setting a restriction on the selling quantity, mode 5 shows a selling test mode, mode 6 shows a price setting mode, and mode 7 shows a discounting sum setting mode.

3. Operation for Setting Discounting Sum

Figure 16:
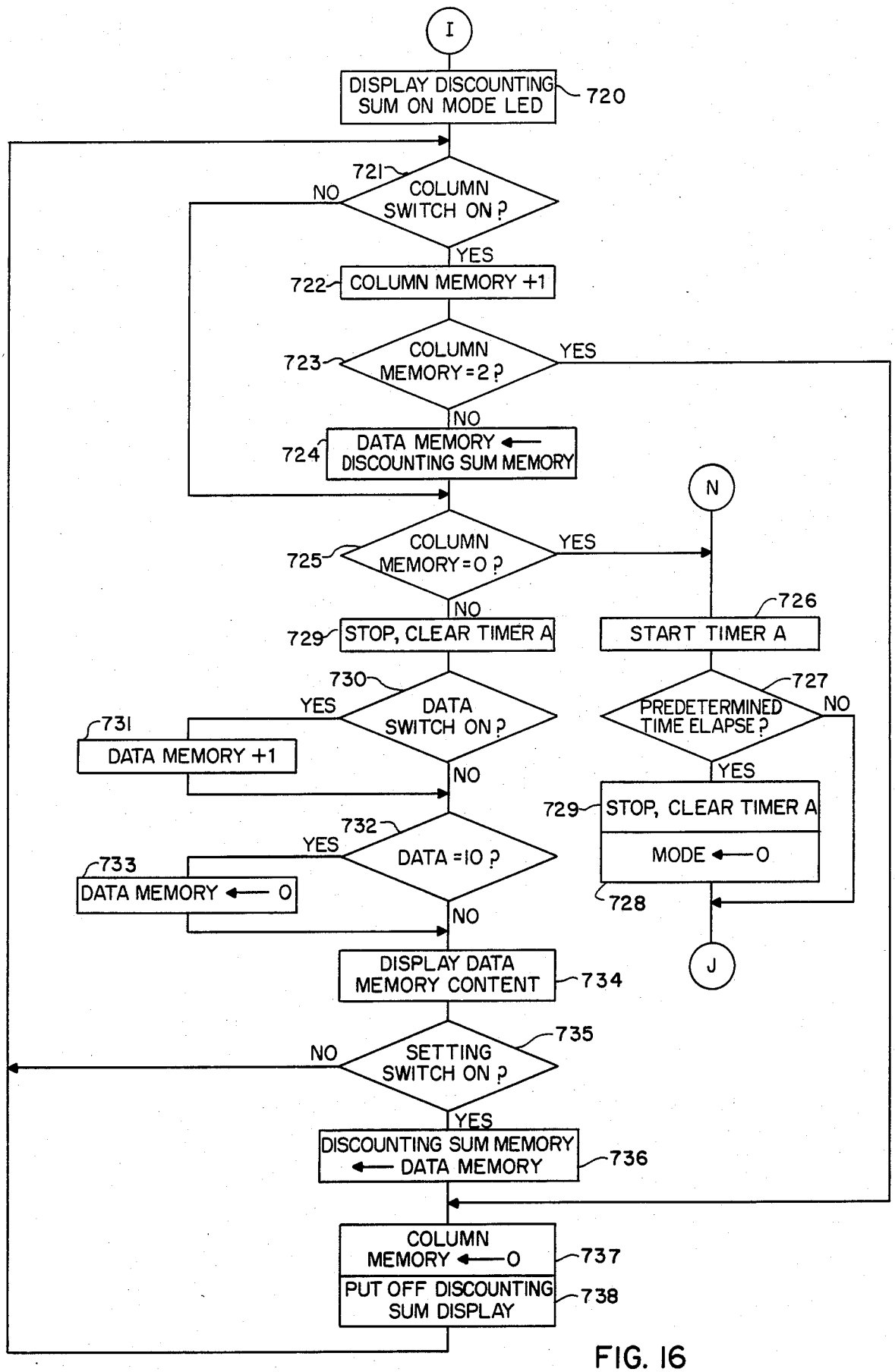

The operation of the discounting sum setting will be explained with reference to FIG. 16. In FIG. 16, the mode LED 137 is lit (other LEDs are put OFF and this is the same hereinafter) at the step 720 to indicate that the mode is in the discounting sum setting mode, and the program then goes to step 721. From step 721, the program goes to step 722 if it detects that the column switch 141 is initially turned ON, but goes to step 725 otherwise. At step 722, "1" is added to the value stored in the column memory 810. At step 723, it is determined whether the value of the column memory 810 is 2 or not (the value of the column memory 810 does not exceed 2 in this mode). If it is 2, the program goes to step 737, but if not, the program goes to step 724. At step 724, the value stored in the discounting sum memory 824, in which the discounting sum is set by a 10 unit money value in BCD 2 digit and is also stored in the data memories 812, 813, 814, whereupon the program goes to step 725. The data memories 812, 813, 814 are provided corresponding to the LEDs 112, 113, 114 respectively and, since the unit is displayed by cents in the case of the discounting sum of money, the value of the data memory 814 at "1" digit is always rendered zero.

Then, at the step 725, it is determined whether the value in the column memory 811 is zero or not. The program goes to step 726 if it is zero and to step 729 if it is not zero. At step 729, the timer A as described below is stopped and the counted content is cleared to go to step 730. The program proceeds from step 730 to step 731 when the data switches 141, 143 corresponding respectively to the data memories 812, 813 are turned on respectively, and to step 732 otherwise. At step 731, the setting data is changed by adding "1" to the value stored in the data memory corresponding to the data switch turned ON, and the new data is stored into the corresponding data memory. The depression of the data switch 144 corresponding to the data memory 814 is negligible here since it is not required to change the content in the data memory 814.

At step 732, it is determined whether the value stored in the data memories 812, 813 is 10 or not. If it is 10, the value 10 in the data memory is reduced to zero at step 733 and then the program goes to step 734. The change can be made for each digit independently with no carry.

At step 734, the content of the data memories 812, 813, 814 is displayed on the LED 11 and the unit LED 121 is lit to indicate that the monetary unit is cents, and then the program goes to step 735. The program goes from step 735 to the step 736 when the setting switch 145 is turned ON, but returns to the step 731 if this does not occur. At step 736, the value of the data memories 812, 813 is stored in the discounting sum memory 824 to go to the step 737. At step 737, the value of the column memory 811 is reduced to zero. At step 738, the LED 11 and the unit LED 121 displayed at step 734 are turned off and the program returns to step 721. At step 726, a timer (not shown) is started (start for the time counting), and the program then goes to 727. At step 727, it is determined whether the counted content of the timer A has arrived at a predetermined value. The program then returns to 502 shown in FIG. 4, while interrupting the timer A and the content of the counted time if the count has reached the predetermined count, but goes to step 502 if it has not.

Timer A is employed for automatically returning to the mode 0 if the mode switch 146 or the column switch is not depressed within a predetermined of period (for instance 30 sec) when in a mode other than mode 0 to thereby enable sales to be performed even if the operator has forgotten to return operation to the mode 0 after the completion of predetermined setting operations. If the mode switch 146 is depressed within a predetermined of time, the timer is cleared at the step 509 shown in FIG. 4 and the timer A does not perform counting up to the predetermined time. Further, if the column switch is depressed within a predetermined time, the timer A stops its operation at the step 729. The operation of the timer A is the same as in other modes.

Figure 24:
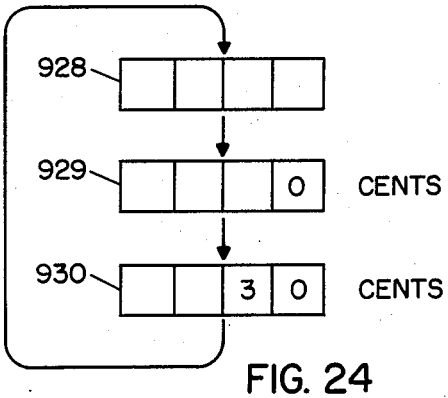

FIG. 24 shows one example of display for setting the discounting sum, in which 928 indicates the non-display state before the column switch 149 is depressed. Upon depression of the column switch 149 once, the discounting sum set in the discounting sum memory 824 is stored in the data memory 812 or the like at step 724, and the value is displayed as shown by 929 at the step 734 to indicate that the discounting sum has been set to zero. Then, upon depression of the data switch 143 at the second digit once and twice, 10 cents and 20 cents are displayed, respectively. Upon depression three times, 30 cents is displayed as shown by 930. Further depressions will result in incremental increases in the display. If the setting switch 145 is depressed when the display indicates 30 for setting the discounting sum to 30 cent, the discounting sum 30 is stored in the discounting memory 824, and the display is returned to the non-indication shown by 928.

4. Operation for the Selling Price Setting Mode

Figure 15:
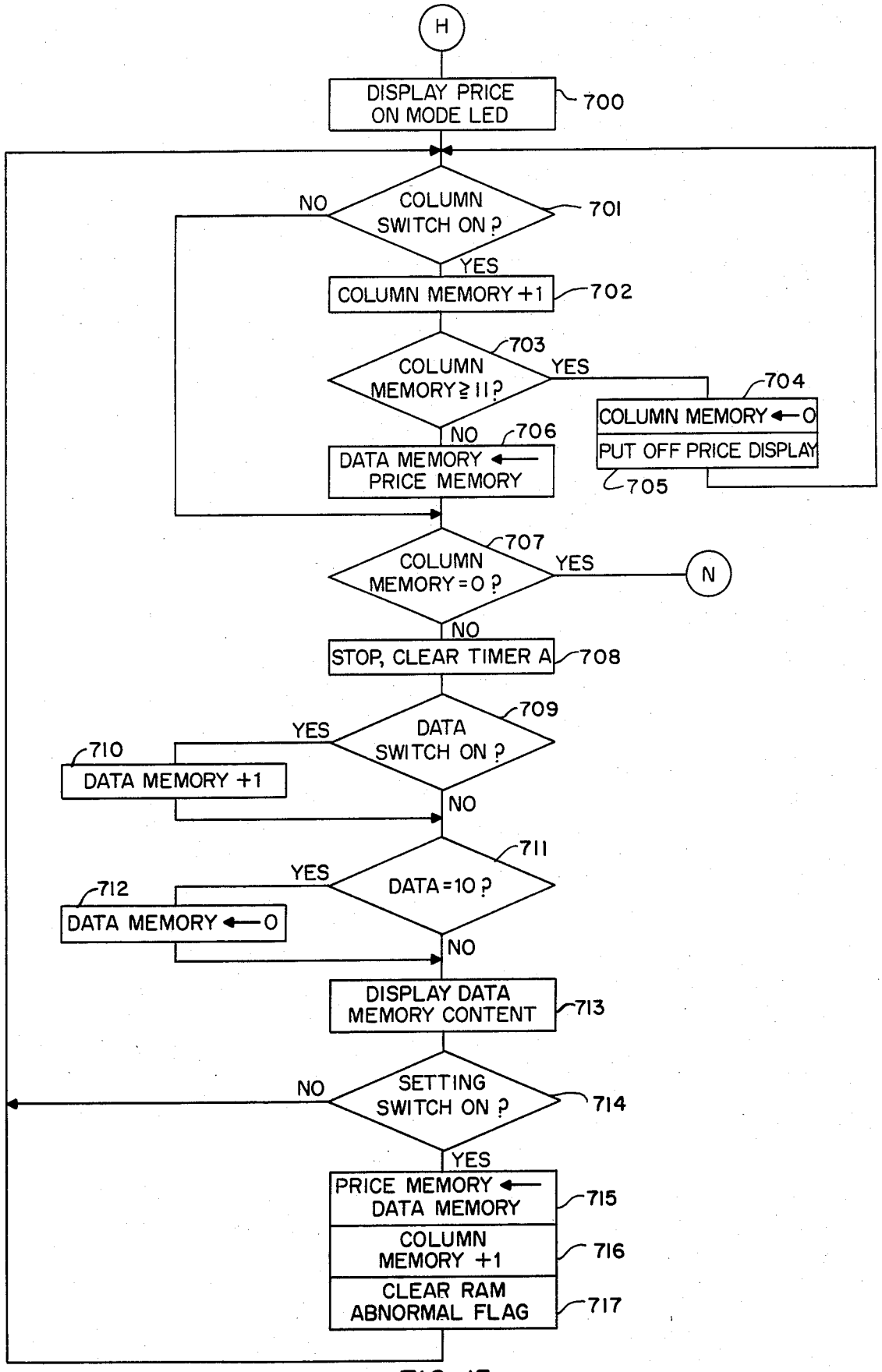

With reference to FIG. 15, explanation will now be given on the selling price setting mode. In FIG. 15, the LED 136 is lit at step 700 to indicate that the mode is in the selling price setting mode whereupon the program then goes to step 701. The program goes from step 701 to step 702 if the column switch 701 is turned ON, but otherwise goes to step 707. At step 702, "1" is added to the value of the column memory before going to step 703. At step 703, it is determined whether the value in the column memory is 11 or greater. If it is 11 or greater the program goes to step 704, and if it is not the program goes to step 706.

At step 706, among 10 selling prices set by the 10 cent unit in BCD 3 digit to No. 1–No. 10 price memories 817–820, those selling prices corresponding to the value of the column memory 811 are stored in the data memories 812, 813, 814. Next, at the step 707 it is determined whether the value of the column memory 811 is zero or not, and the program goes to step 726 in FIG. 16 if it is zero, and to step 708 if it is not zero. After stopping the timer A and clearing the content thereof as described above in step 708, the program goes to the step 709.

When in step 709, the program goes to step 710 if the data switches 142, 143, 144 are turned ON, and to step 711 if not. At step 710, "1" is added to the value for each of the data memories 812, 813, 814 corresponding to the data switches turned ON. Next, at step 711 it is determined whether the value stored in the data memories 812, 813, 814 is 10, and the program goes to step 712 if it is 10, and to step 713 if it is not 10.

At step 712, the content 10 presently stored in the data memories 812, 813, 814 is reduced to zero respectively, and then the program goes to step 713. In this case, each of the digits can be changed independently with no carry. At the step 713, the column number for the set price shown by the value in the column memory 811 is displayed on the LED 111; the set price (or price having been set) shown by the data memories 812, 813 is displayed on the corresponding LEDs 112, 113, 114 respectively; and the LED 122 is lit to display the unit 10 cents, after which the program goes to step 714.

When in step 714, the program goes to step 715 if the setting switch 145 is turned ON, and returns to the step 701 if not. At step 715, values stored in the data memories 812, 813, 814 are stored (set) in the price memory shown in the column memory 811, after which the program goes to step 716. At step 716, "1" is added to the value of the column memory 811 for setting the next price. At step 717, the RAM abnormal flag in the abnormal flag memory 809 which has been set at the step 504 is reset before returning to step 701. The RAM abnormal flag is reset here, because since the RAM abnormal flag had been set in the case where the price setting or the like was destroyed when there was a drop in the voltage of the back-up power source for RAM 8, reset is necessary when setting is made again. The RAM abnormal flag may be reset after confirming the setting for all of the setting items, or may be reset after confirming the setting for a minimum number of setting items required for the usual selling. At step 704, the content stored in the column memory 811 is reduced to zero. Next, at the step 705 the LED 11 and the unit LED 122 displayed at the step 713 are turned off, after which the program returns to step 701.

Figure 23:
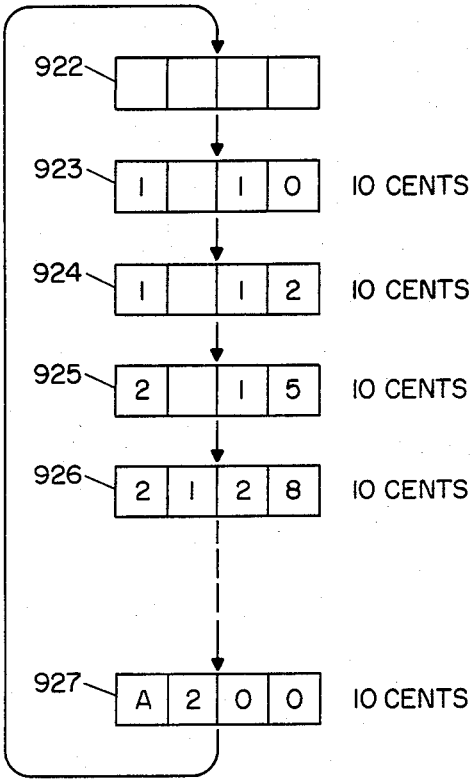

A display example for the selling price setting mode will be explained referring to FIG. 23. The state before the column switch 141 is depressed is shown at 922. When the column switch is depressed once, the price column number is displayed as "1" and the price set to the No. 1 price memory 818 is displayed as 100 money units as shown by 23. Then, upon depression of the data switch 144 once, 110 money units are displayed. Another depression will cause 20 money units to be displayed as shown by 924. Further depressions will cause incremental increases in money units to be displayed. Then, upon depression of the setting switch 145, 120 money units is stored in the No. 1 price memory 818.

Thereafter, the price 150 money units in the No. 2 price memory 819 is displayed as shown by 925. Then, upon depressing the data switch 142 once, the data switch 143 once, and the data switch 144 three times, 1280 money units will be displayed as shown by 926.

Then, upon depression of the setting switch 145, 1280 money units will be stored in the No. 2 price memory 819. Thereafter, the No. 3 setting state and further setting states are obtained in the same manner, with respect to the price required for the change of setting, setting data is changed by the data switch and, thereafter, the setting switch is depressed.

When the price for a particular item does not need to be changed, the column switch should be depressed to proceed to the next price column. The setting operation proceeds up to the content display (2000 money units) in the No. 10 price memory 820 as shown by 927. The price column number for No. 10 is displayed as "A" on the LED 111. The No. 10 can also be changed for the setting, and where no change is necessary for price of No. 10, non-display state shown by 922 is resumed by depressing the column switch 141.

5. Operation for Setting Mode of Selling Quantity Restriction

Figure 13:
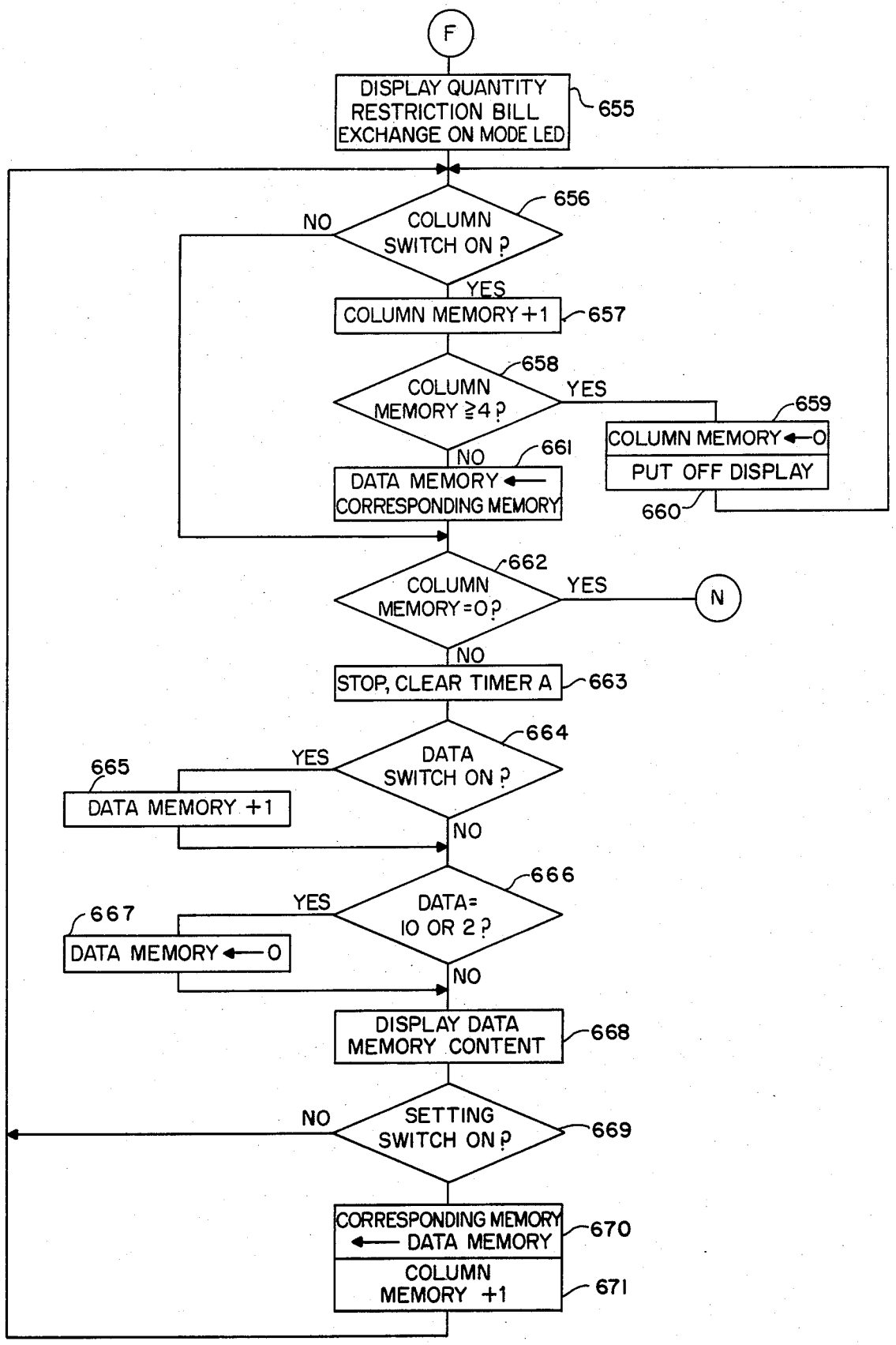

With reference to FIG. 13, an explanation will now be given concerning the operation for setting the selling quantity restriction as another setting mode. At step 655, the mode LED 134 is lit to indicate that the mode is in the setting mode of the selling quantity restriction before going to step 656. The operation hereinafter described is basically same as in the selling price setting mode and the discounting sum setting mode, but with differences in some details such as for the unit display.

The program goes from step 656 to step 657 if the column switch is turned ON, and to the step 662 if not. At step 657 "1" is added to the value of the column memory 811. Next, at step 658, it is determined whether the value in the column memory is 4 or greater, and the program goes to step 659 if it is 4 or greater, and to step 659 if it is not. At step 661, the data memory 811 is stored with the value of the restriction quantity memory 821 in BCD 1 digit if the value of the column memory 811 is 1, is stored with the value of the temporarily bill reservable number memory 822 in BCD 1 digit if the value is 2, and is stored with the value of the exchange flag memory 823 if it is 3.

At step 662, it is determined whether the value of the column memory 811 is zero or not, and the program goes to step 726 in FIG. 16 if it is zero, and to step 663 if it is not zero. At step 663, the timer A is stopped and cleared as described above. At step 664, the program goes to the step 665 if the data switch 144 is turned ON, and to step 666 if not. At step 665, "1" is added to the value of the data memory 814. At step 666, it is determined whether the value of the data memory is 10 or not if the column memory is 1 or 2 (restriction quantity or bill temporarily reservable number), and whether it is 2 or not if the column memory is 3 (exchange). The program goes to step 667 if it is 10 or 2, and to step 668 if it is not 10 or 2.

At step 667, the content of the data memory 814 is reduced to zero, and then the program goes to 668. The data switches 142, 143, are negligible here since only one digit of data may be set. At step 668, the kind of data to be set is displayed on LEDs 111, 112 in accordance with the value of the column memory as "HS" for the restriction quantity, as "ES" for the bill temporarily reservable number and as "CH" for exchange. Also, the content of the data memory 814 is displayed on the LED 114, the LED 123 is lit upon setting the quantity restriction, and the bill temporarily reservable number to indicate the unit number and no display is made for the unit upon exchange setting.

The program goes from step 669 to step 670 if the setting switch 669 is turned ON, but otherwise returns to step 656. At step 670, the value of the data memory 814 identified by column memory 811 is stored in the memory 821, 833, 823. At step 671, the value of the column memory 811 is incremented by "1", after which the program returns to step 656. At step 659, the content of the column memory is reset to zero, and at step 660, the LED 11 and the unit LED which were energized at step 668 are turned off. The program then returns to step 656.

Figure 22:
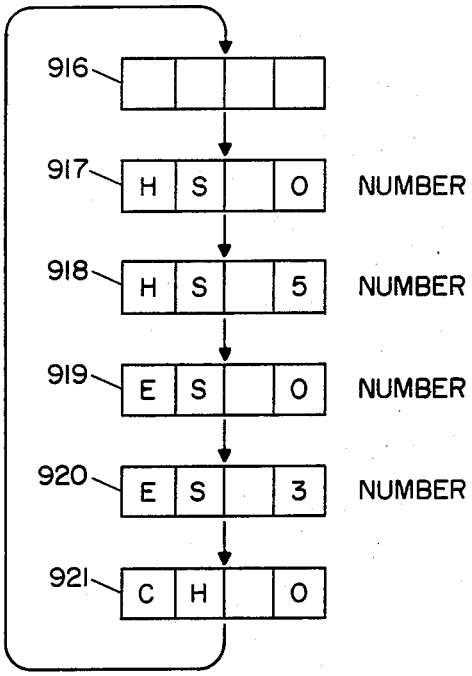

FIG. 22 shows an example of the display in the setting mode for the selling quantity restriction as described above. In FIG. 22, 916 shows the display state before the column switch 141 is depressed. When the column switch 141 is depressed, the display as shown by 917 indicates that the selling quantity restriction (HS) has been set to zero (judged as no selling restriction). When the data switch 144 is depressed five times, the display becomes as shown at 918. Upon depression of the setting switch 145, "5" is stored (set) in the quantity restriction memory 821 and, thereafter, the display as shown by 919 indicates that the bill temporarily reservable number (ES) has been set to zero (sheet). Upon depression of the data switch 144 three times, the display becomes as shown at 920. Then, by depressing the setting switch 145, "3" is stored (set) in the bill temporarily reservable memory 822 and, thereafter, the display indicates at 921 that the exchange has been set to zero (indicating no exchange state). In this case, if it is required to set the exchange, the data switch 144 is depressed once to display "1" (indicating an exchange state), and, thereafter, the setting switch 145 is depressed to store "1" in the exchange flag 823. If it is not required for exchange, the display is returned to the non-display state as shown by 916 by depressing the column switch 141.

6. Operation for Usual Selling Mode

Figure 7:
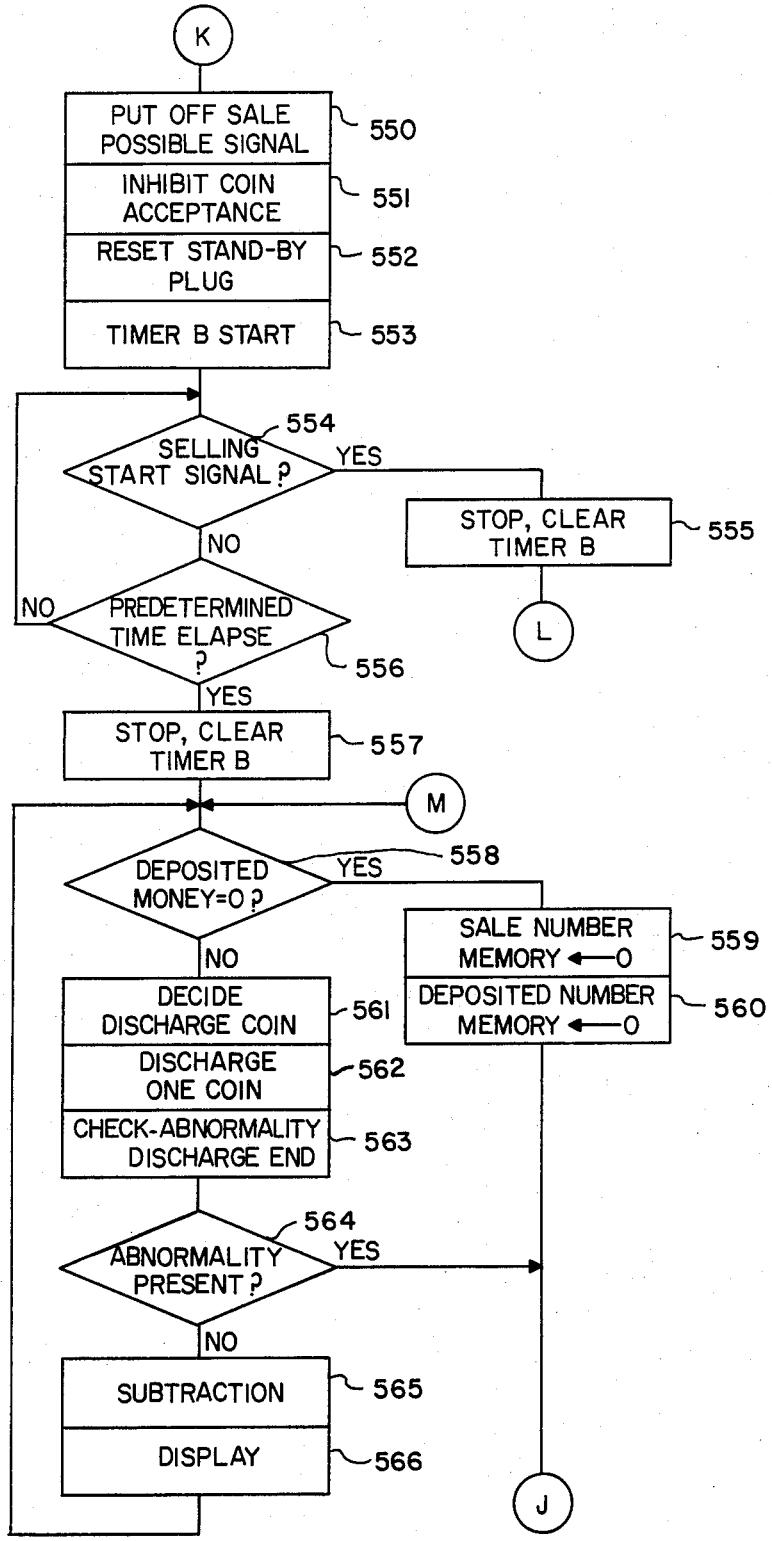
Figure 8:
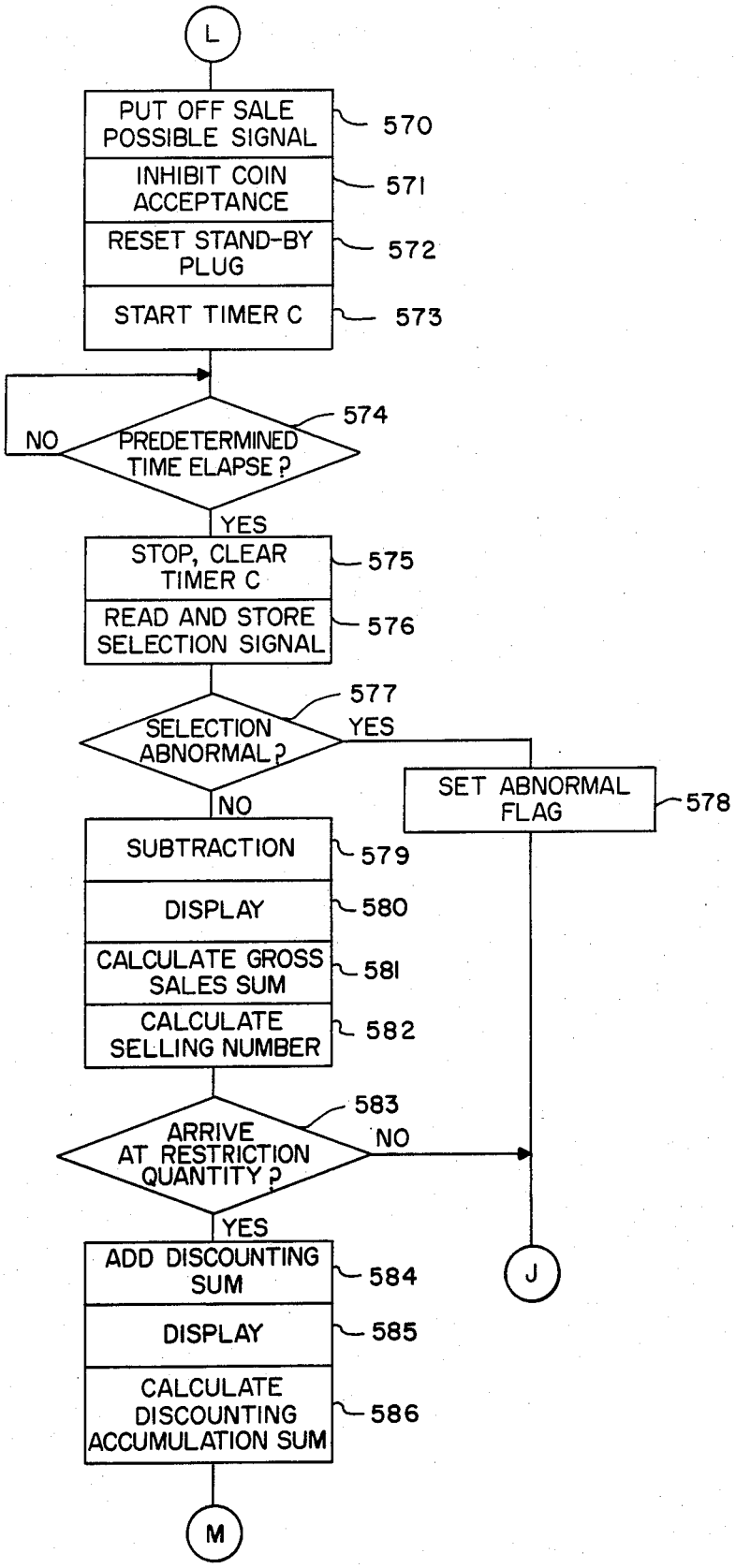

An explanation will now be given for the operation during the usual selling mode. The operation is shown in FIG. 6, FIG. 7 and FIG. 8.

Figure 6:
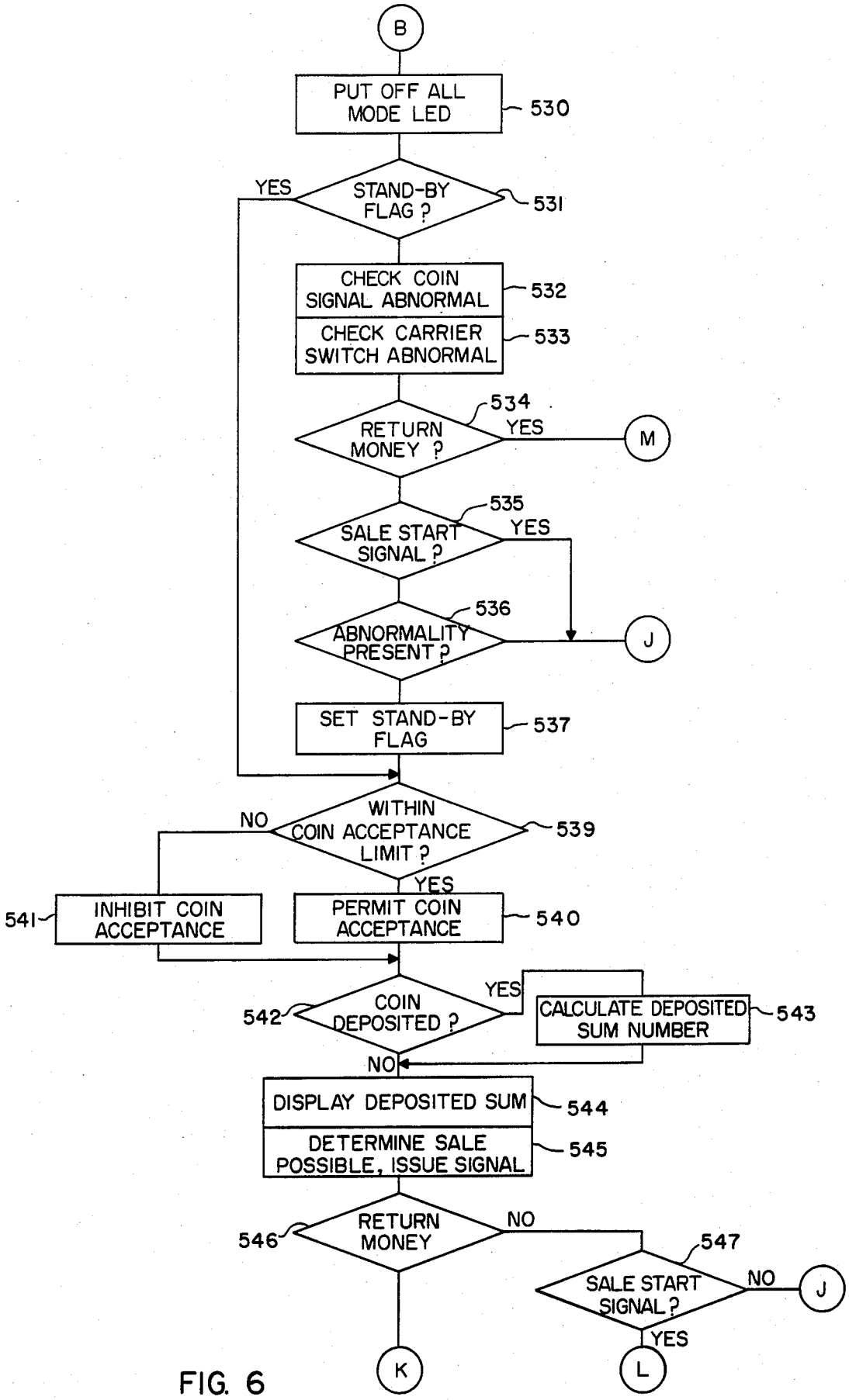

Referring to FIG. 6, at step 530, all of the mode LEDs 13 are turned off to indicate that the machine is in the usual selling mode. At step 531, it is determined whether the stand-by flag 815 is set or not, and the program goes to step 539 if it is set and to step 532 if it is not set. The stand-by flag is not set in the state after the operation for the selling price setting, after the operation for the change recovery described below, after the operation for the selling test, selling or money returning operation in the usual selling mode, and after the supply of the main power source. The stand-by flag is provided for checking the abnormality after step 532 and for carrying out the stand-by operation (returning to the stand-by state) if there is no abnormality.

At step 532, in response to coin signals issued for each of the coin denominations from the coin selecting device 3 and the bill distinguishing device, corresponding flags are set in the abnormal flag memory 809. For coin denominations not having such signals, corresponding flags are reset before going to step 533. Specifically, if the coin signal is produced after the operation, it is abnormal.

At step 533, it is determined whether the carrier switch mounted to a change discharge drive motor in the change discharge device 2 is turned ON or not. In the case where it is turned ON, and if the abnormality in the change discharge device 2 has not been stored in the abnormal flag memory 809 in the money return operation or the like, the change discharge drive motor is driven until the carrier switch is turned OFF to return the motor to the stand-by position. In the case where the carrier switch is not turned OFF within a predetermined of time (for instance, 3 sec) when the motor is driven, the driving for the motor is stopped because it is assumed that the motor is locked, and the corresponding flag in the abnormal flag memory 815 is set. Flags showing the abnormality in the change discharge device 2 include, in the abnormal flag memory 809, a motor lock flag showing that the motor is locked, and a motor drive stopped flag showing that the motor drive is stopped and the setting motor is not rotated where the carrier switch is not turned ON within a predetermined period (for instance, 400 msec) after the driving of the motor.

At step 534, it is determined whether a money return signal from the coin selecting device is inputted or not when a customer demands the return for a deposited sum of money by the operation of the return lever. The program goes to step 558 in FIG. 8 if a money return signal is inputted and to step 535 if it is not inputted. At step 535, it is determined whether the sale start signal as described above from the automatic vending machine main body is inputted or not. The program returns to step 502 in FIG. 4 if the signal is inputted and to step 536 if it is not inputted. At step 536, it is determined whether abnormality data is stored in the abnormal flag memory 809 or not. The program returns to step 502 in FIG. 4 if abnormality data is stored and to step 537 if no abnormality data is stored. At step 537, the stand-by flag 815 is set and the program then goes to step 539.

At step 539, a comparison is made before the restriction number for the deposited coin denominations determined due to the capacity of the change discharge device 2, the number set in the bill temporarily reservable number memory 822, and the determined maximum deposited sum, the content of the deposited number memory 802 on each denominations and the deposited sum memory 801 to determine whether the money deposited is within the coin acceptable restriction (i.e., within a range where all of the deposited money can be returned). The program goes to step 540 if it is within the coin acceptable restriction and to step 541 if it is not. At step 540, a signal for allowing the acceptance of coins is issued to the coin selecting device 3 or the bill distin9uishing device, after which the program goes to step 42. At step 541, a signal for inhibiting the acceptance of coins is issued to the coin selecting device or the bill distinguishing device, after which the program goes to step 542.

A signal for allowing or inhibiting the acceptance of coins issued to the coin selecting device 3 may be provided for each coin denomination. Alternatively, a single signal may be provided for inhibiting the acceptance of all coin denominations when acceptance of any one coin denomination is inhibited.

The program goes from step 542 to step 543 when the coin signal for each of the denominations from the coin selecting device 3 or the bill distinguishing device is inputted, but otherwise the program goes to step 544. At step 543, the sum of deposited coins is added to the value stored in the deposited sum memory 801 in the BCD 3 digit by money units based on the inputted coin signal, the sum is stored in the deposited sum memory 801, and "1" is added to the value of the deposited number memory 802 on each of the denominations before going to step 544. That is, the deposited sum and the number of coins of each denomination are calculated and stored upon every deposit of coins.

At step 544, the value of the deposit sum memory 801 is displayed on the LED 11 and the money units is displayed by lighting the LED 121, after which the program goes to step 545. At step 545, the deposited sum stored in the deposited sum memory 801 and the selling price set in the price memories 811, 820 are compared. After considering the presence or absence of the change on each denomination in the change discharge device 2 and the deposited number stored in the deposited number memory 802, it is determined whether a difference between the deposited sum and the set selling price can be returned to the customer as change, and whether the deposited money is sufficient for the requested sale. If the requested sale is possible, the above-mentioned sale possible signal for allowing dispense of the chosen commodity is issued to the automatic vending machine main body, and the program then goes to step 546. At step 546, it is determined whether a money return signal has been produced in response to a customer demanding the return of deposited money. The program goes to step 550 shown in FIG. 7 if such a signal has been produced and to step 547 if it has not. At step 547, it is determined whether a commodity selection button has been depressed to input the sale start signal from the automatic vending machine main body. The program goes to step 570 shown in FIG. 8 if it is inputted, but returns to step 502 shown in FIG. 4 if it is not inputted. That is, FIG. 7 shows the money return operation and FIG. 8 shows the selling operation.

7. Money Return Operation

Referring to FIG. 7, at step 550, all of the sale possible signals issued during step 545 in FIG. 6 are eliminated, and the program then goes to step 551. At step 551, a signal for inhibiting the acceptance of coins is issued to the coin selecting device 3 and the bill distinguishing device. Next, at step 552, the stand-by flag 815 is reset. Then at step 553, the time counting operation of a timer B (not shown) is started, and the program then goes to step 554. At step 554, it is determined whether the above-mentioned sale start signal is inputted or not, and the program goes to step 570 in FIG. 8 after interrupting and clearing the timer B if the signal is inputted, and to step 556 if it is not inputted. At step 556, it is determined whether the timer B has counted a predetermined time (about 300 msec), and returns to step 554 if the time has not counted, and to step 556 if it has counted. That is, the timer B is used for giving a preference to the selling operation in the case where the sale start signal is inputted within a predetermined time (about 300 msec) after the input of the money return signal, so as to prevent the misoperation of simultaneously dispensing the commodity and returning the deposited sum.

At step 557, the timer B is interrupted and cleared. Next at step 558, it is determined whether the value stored in the deposited sum memory 801 is zero or not, and the program goes to step 559 if it is zero and to step 61 if it is not zero. At step 561, the discharge coin or change cylinder is actuated so that coins of higher denomination are discharged preferentially while considering the value of the deposited sum memory 801, the value of the deposited number memory 802 for each coin denomination, the presence or absence of changes on each change cylinder of the change discharging device 2 and the setting state for the exchange flag 823. Next, at step 562, a discharge signal for the determined one coin is outputted, and the program then goes to step 563. At step 563, the program checks to see whether one coin has been discharged normally or not by using a carrier switch or the like. If it has not been completed normally, a predetermined flag in the abnormal flag memory 809 is set, after which the program goes to step 564. The abnormal flag for the change discharge device 2 includes two flags as described above. In the case where an abnormality is generated in the bill distinguishing device, since the kind of the abnormality is inputted by way of the connector 6, a predetermined flag in the abnormal flag memory 809 is set on the particular kind of abnormality detected. At step 564, it is determined whether an abnormality is stored in the abnormal flag memory 809, and the program returns to step 502 in FIG. 4 if an abnormality is stored and to step 65 if it is not stored.

At step 565, the sum of the discharged coin is subtracted from the value stored in the deposited sum memory 801. If the deposited number of the discharged coins is stored in the deposited number memory 802, the value of this memory 802 is decreased by one. Then at step 566, the balance stored in the deposited sum memory 801 is displayed on the LED 11, and the program then returns to step 558. Specifically, discharge of money is carried out until the balance stored in the deposited sum memory 801 is reduced to zero. At step 559, the content of the selling number memory 803 for storing a successive of continuous selling numbers as described later is reduced to zero. Next at step 560, the content of the deposited number memory 802 is reduced to zero, after which the program returns to step 502 in FIG. 4.

8. Selling Operation

Referring to FIG. 8, at step 570, all of the sale possible signals issued during step 545 in FIG. 6 are eliminated, and the program then proceeds to step 571. At step 571, a signal for inhibiting the acceptance of coins is issued to the coin selecting device 3 and the bill distinguishing device. Then, at step 572 the stand-by flag 815 is reset, and at step 573 time counting of a timer C (not shown) is started. Next, at step 574, it is determined whether the timer C has counted a predetermined of time (about 300 msec), and the program goes to step 575 when it has. At step 575, the timer B is stopped and reset. At step 576, the selection signal for each of the price columns as described above inputted from the automatic vending machine main body by way of the connector 5 is read and stored into the RAM 8. That is, the selection signal is stored after the elapse of a predetermined amount of time (about 300 msec) from the input of the sale start signal.

Next, at step 577, it is determined whether the inputted selection signal is one or not. If two or more signals are inputted, it is considered as an abnormality of double selection or as such an abnormality that the sale is not possible for that price (i.e., a sale possible signal is not issued) and the corresponding flag in the abnormal flag memory 809 is set at step 578, after which the program goes to step 502 in FIG. 4. However, the program goes to step 579 if less than two signals are inputted.

At step 579, the selected price (the value in one of the price memories 811–820 indicated by the selection signal) is subtracted from the value stored in the deposited sum memory 801 and the balance is stored in the deposited sum memory 801, and at step 580, the balance stored in the deposited sum memory 801 is displayed on the LED 11. At step 581, the price of the commodity just sold is added to the value of the gross sales-to-date sum memory 804 and at step 582, "1" is added to the value of the gross sale number in the gross sale number memories 806–808 for the particular commodity price, and "1" is added to the value in the sale number memory 803.

At step 583, it is determined whether the sale number has reached a restriction quantity by comparing the value in the sale number memory 803 with the value set in the restriction quantity memory 821. The program goes to the step 584 if the sale number has reached the restriction quantity, but returns to step 502 in FIG. 4 if it has not reached it. At step 584, the value set in the discounting sum memory 824 is added to the value stored in the deposited sum memory 801. Next, at step 585 the value of the deposited sum memory 801 is displayed on LED 11, and then at step 586 the value set in the discounting sum memory 824 is added to the value of the discounting accumulation sum memory 805 and stored in the memory 805 after which the program goes to step 558 in FIG. 7. Then, after discharging change until the content of the deposited sum memory 801 is reduced to zero, the sale number memory 803 and the deposited number memory 802 are cleared at the steps 558, 560 after which the program returns to step in FIG. 4. In this case, while the selling restriction quantity set in the restriction quantity memory 821 is used also as the quantity for discount, it may be set separately. Further, since the gross sales sum includes the discounting sum and a value the discounting sum is stored separately, it is advantageous in that the number of the discounting operation can be recognized, and any disagreement between the gross sales sum calculated from the gross sale number on each of the price columns and the set price and the value of the gross sale sum memory 804 can be avoided.

9. Operation for Change Recovery Mode

Figure 9:
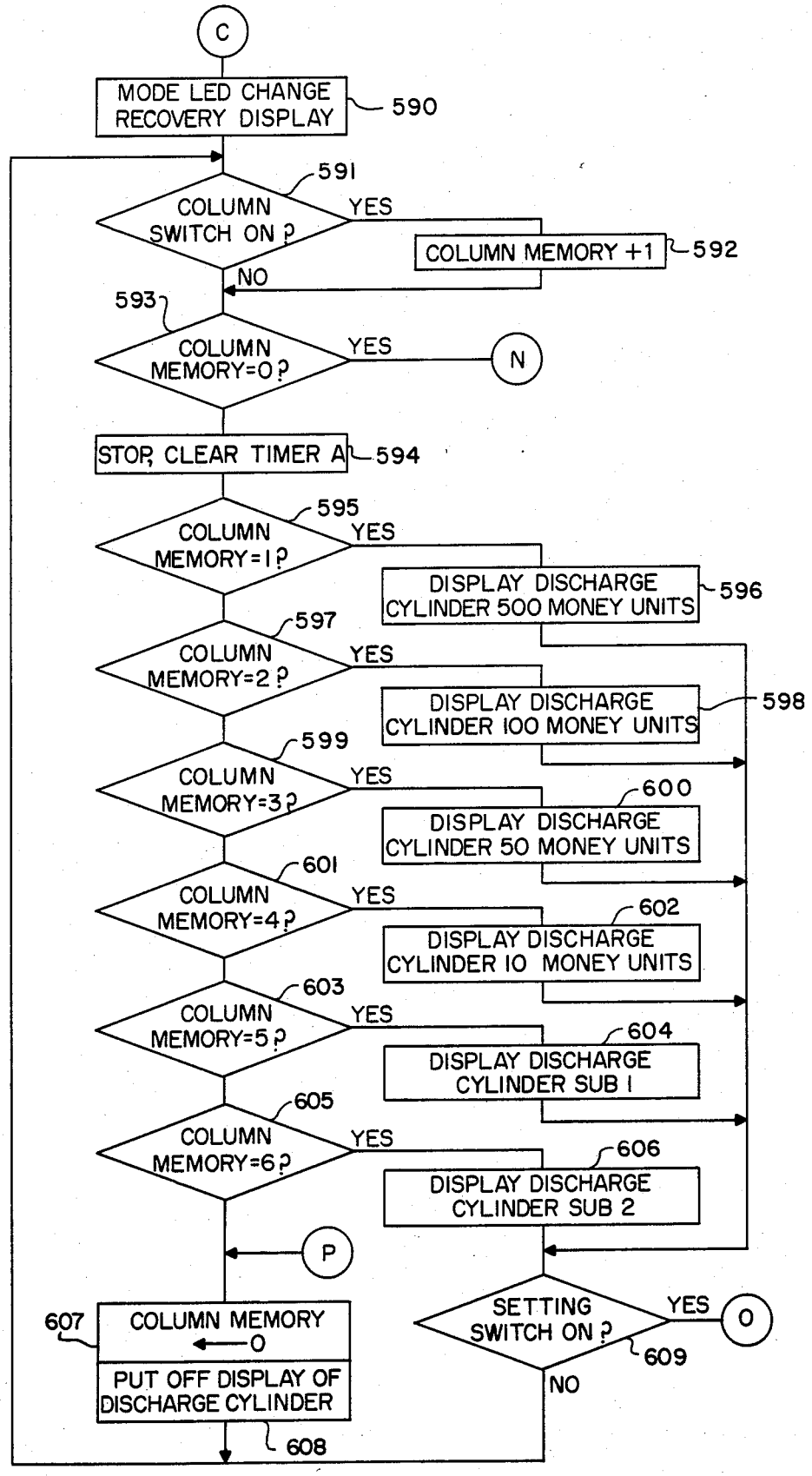

An explanation will now be made of the operation for the change recovery mode in conjunction with FIG. 9 and FIG. 10. FIG. 9 shows the operation for selecting the discharging (recovering) change cylinders and FIG. 10 shows the operation for the discharge and stop of discharge of the selected change cylinder.

Figure 25:
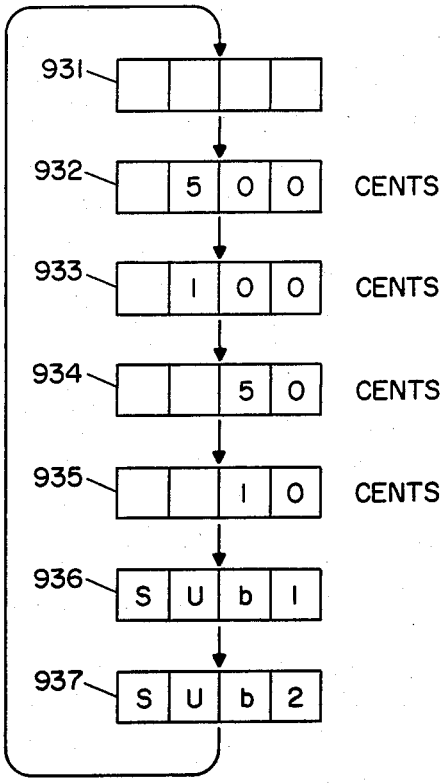

Referring to FIG. 9, at step 590, the LED 131 is lit to indicate that the mode is in the change recovery mode, after which the program goes to step 591. The program goes to step 592 from step 591 when the column switch 141 is turned ON, but directly to step 592 otherwise. At step 592, "1" is added to the value of the column memory 811 and the program then goes to step 593. At step 593, it is determined whether the value of the column memory is zero or not, and the program goes to step 594 if it is not zero, and to step 726 in FIG. 16 if it is zero. At step 594, the timer A as described above is stopped and cleared, and the program then goes to step 595. At steps 595–606, it is detected whether the column memory 811 has a value of 1–6. As shown in FIG. 25, the discharge cylinder is displayed as 500 money units on the LED 11, and the unit LED 121 as shown by 932 if it is "1", displayed as 100 money units as shown by 933 if it is "2", displayed as 50 money units as shown by 934 if it is "3", displayed as 10 money units as shown by 935 if it is "4", displayed as sub1 as shown by 936 if it is "5", and displayed as sub2 as shown by 937 if it is "6", after which the program goes to step 609. If the column memory has a value other than 1–6, the program goes to step 607. At step 607, the content of the column memory 811 is reduced to zero, after which the program goes to step 608. At step 608, the display of the discharge cylinder is turned off as shown by 931 in FIG. 25 and the program returns to step 591.

Figure 10:
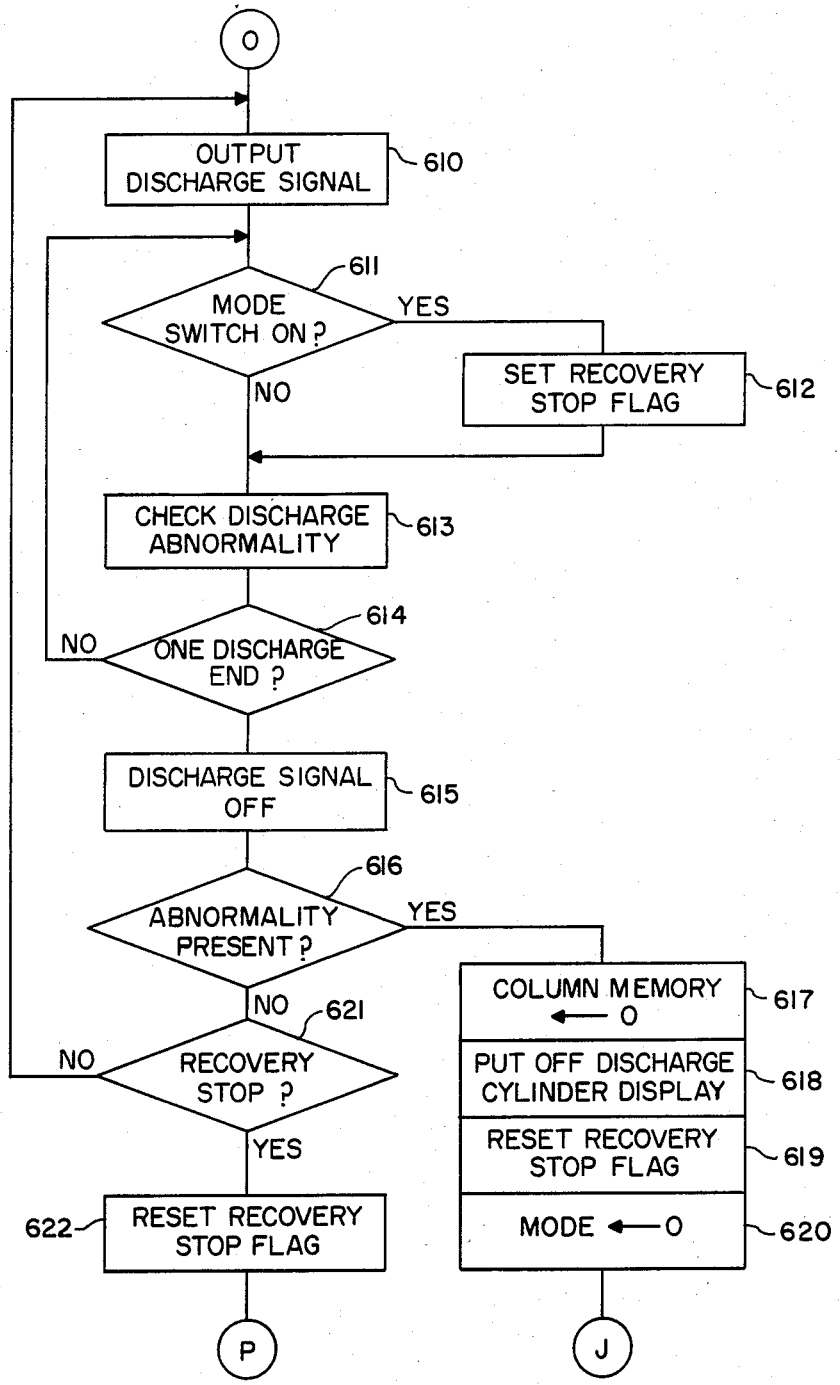

The program goes from step 609 to step 610 in FIG. 10 if the setting switch 145 is turned ON, but returns to step 591 otherwise. Specifically, a selection for the discharging (recovering) change cylinder can be made by the number of depressions of column switch 141 until the setting switch 145 is depressed.

Referring to FIG. 10, at step 610, a discharge signal for the selected change cylinder (as indicated by the column memory 811) is issued to the change discharge device 2 and the program then goes to step 611. The program goes to step 612 from step 611 if the mode switch is turned ON, but to step 613 otherwise. At step 612, the recovery stop flag 825 is set. Next, at step 613, it is determined whether or not the carrier switch is turned ON within a predetermined time after the issue of the discharge signal, and turned OFF within another predetermined time to normally complete the discharging operation for one coin while going around the loop between step 611. Then, if there is abnormality the corresponding flag in the abnormal flag memory 809 is set, but if there is not abnormality the program goes to step 615 upon turning OFF of the carrier switch.

At step 615, the discharge signal issued at step 610 is eliminated and the program proceeds to step 616. At step 616, it is determined whether an abnormality is stored or not in the abnormal flag memory 809, and the program goes to step 617 if there is an abnormality and to step 621 if there is no abnormality. At step 621, it is determined whether the recovery stop flag 825 is set or not, and the program goes to step 622 if it is set but returns to step 610 if it is not set. At step 622, the recovery stop flag 825 is reset and the program returns to step 607 in FIG. 9.

At step 617, the column memory 811 is cleared and then at step 618, the display for the discharging change cylinder is eliminated. Next, at step 619, the recovery stop flag 825 is reset, and then at step 620 the mode memory 810 is cleared, whereupon the program returns to step 502 in FIG. 4. Specifically, the discharging operation is continued until the mode switch 146 is depressed unless an abnormality is generated.

The discharge may be stopped automatically after the discharging operation for a predetermined number more than the number contained in the change cylinder, or after a sufficient time has elapsed for discharging a predetermined number or a predetermined time after the detection for the absence of the change. Further, it may be stopped by the depression of the setting switch (depressed again after the start of the discharge) or of the mode switch. Furthermore, it may be switched to the discharge of another change cylinder not stopping the discharge upon depression of the column switch.

As described above, since the discharging change cylinder is displayed in the change recovery, coins required to be recovered can be recovered with no error and the recovery operation can be faciliated.

10. Operation for the Selling Test Mode

Figure 14:
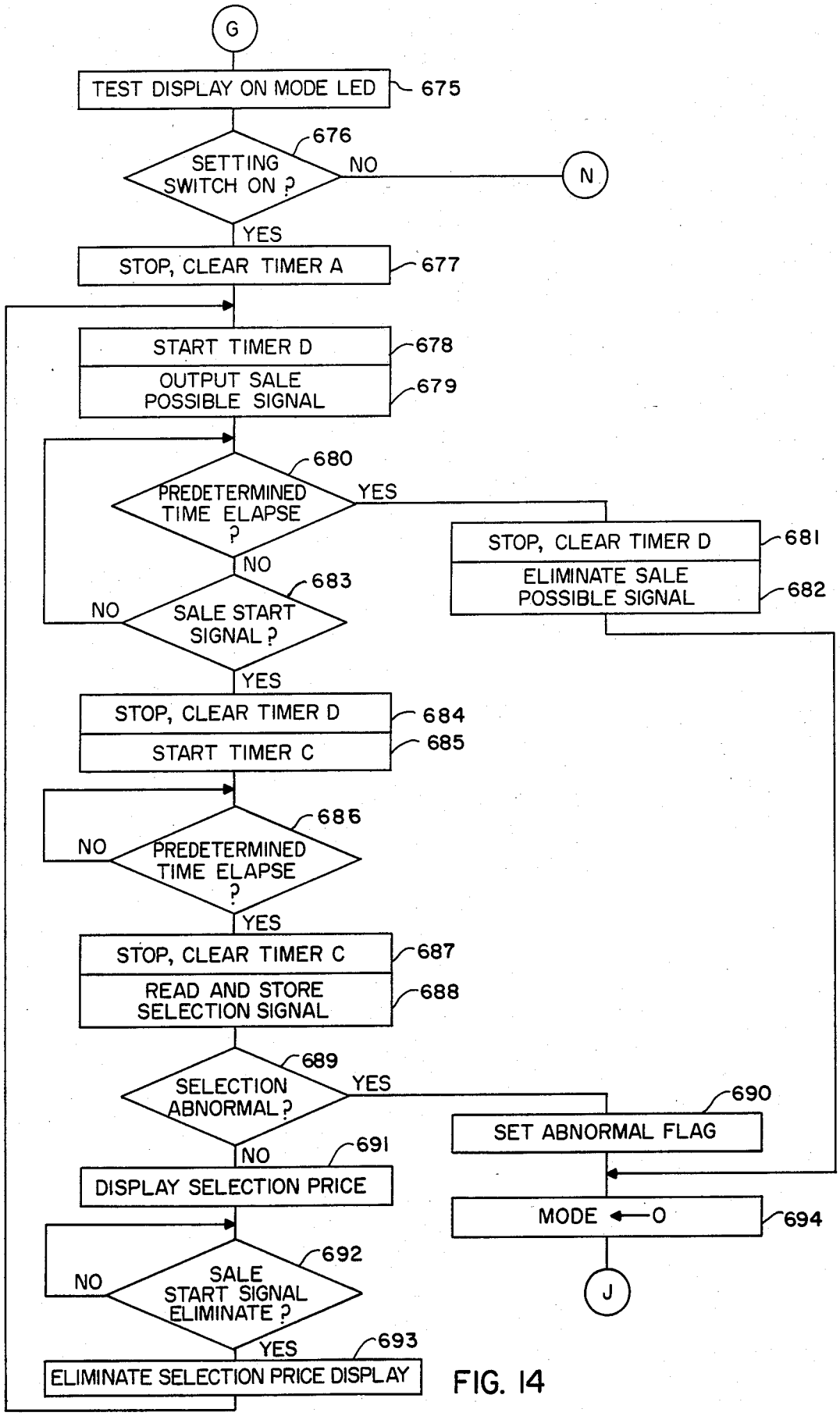

An explanation of the operation for the selling test mode will be given with reference to FIG. 14. At step 675, the mode LED 135 is lit to indicate that the mode is in the selling test mode. Next, at step 676 the program goes to step 766 if the setting switch 145 is turned ON, but to step 726 in FIG. 16 otherwise. At step 677, the timer A as described above is stopped and cleared, and then at step 678, time counting of the timer D (not shown) is started after which the program goes to step 679. At step 679, the above-mentioned sale possible signal (other than that for selling price set to zero money units) is issued and the commodity dispense by the depression of the selection button on the automatic vending machine main body is enabled. At step 680, it is determined whether the timer D has counted a predetermined time period (for instance, 10 sec), and the program goes to step 681 if it has and to step 683 if it has not.

At step 683, it is determined whether the selection button has been depressed to input the sale start signal from the automatic vending machine main body. The program goes to step 684 if the signal has been inputted but returns to step 680 if it has not been inputted. At step 684, the timer D is stopped and cleared, and then at step 685, time counting of the timer C is started.

Next, at step 686, it is determined whether the timer C has counted the same predetermined time (about 300 msec) as in step 574 in FIG. 8, and the program goes to step 687 when it has. At step 687, the timer C is stopped and cleared, and at step 688, the selection signal is read and stored in the same manner as in step 576 in FIG. 8. Then at step 689, any selection abnormality is detected judged in the same manner as in step 577 in FIG. 8, assuming that the price other than that set to zero money units is possible for sale. If there is any abnormality, a predetermined flag in the abnormal flag memory 809 is set in the same manner as in step 578 in FIG. 8 and the program goes to step 594, whereas if there is no abnormality, the program proceeds to step 691.

At step 691, the selected price among those of the price memories 811–820 is displayed by lighting the LED 11 and the unit LED 121. At step 692, completion of the commodity dispensing operation on the side of the automatic vending machine main body is determined, depending on the elimination of the above-mentioned sale start signal, and the program goes to step 639 when the sale start signal is eliminated. At step 693, the display for the selected price initially displayed at step 691 is terminated, and the program returns to step 678. Further, at step 681, the timer D is stopped and cleared before going to step 682. At step 682, all of the sale possible signals issued at the step 679 are terminated and then at step 694, the mode memory 810 is cleared, whereupon the program returns to step 502 in FIG. 4.

The program provides for the sale possible signal to be issued even without depositing coins upon depression of the setting switch 145 at step 676, to enable the commodity to be dispensed by the depression of the selection button. The state is released only when the timer D has counted a predetermined time, but the state may also be released when the setting switch 145 is depressed again, when the mode switch or column switch is depressed, or when the above-mentioned money return signal is inputted. The point of the flow chart to which the program should be returned (to mode zero, to mode 6 or in mode 5 as it is) after the release can be decided as required. Further, since the sale possible signal is not issued instantly but is issued only after the depression of the setting switch 146, when the selling test mode is established by the depression of the mode switch 146, the sale possible signal is safely eliminated during mode selection.

11. Operation for the Gross Sales Mode

Figure 11:
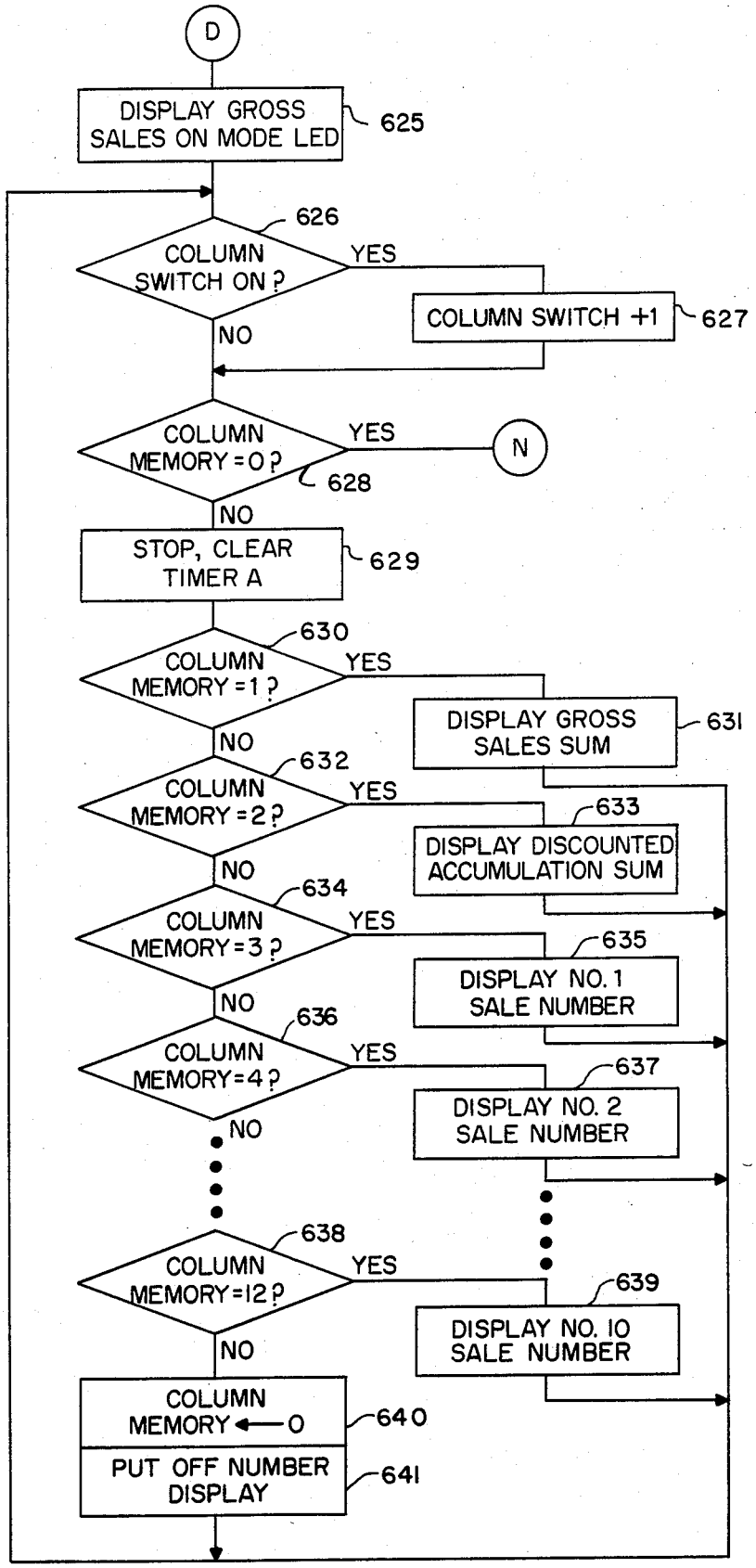

An explanation of the gross sales mode will be given with reference to FIG. 11. At step 625, the mode LED 132 is lit to indicate that the mode is in the gross sales display mode, the program goes from step 626 to step 627 if the column switch 142 is depressed, and to step 628 otherwise. At step 627 "1" is added to the value of the column memory 811. At step 628, it is determined whether the value of the column memory 811 is zero or not, and the program goes to step 726 in FIG. 16 if it is zero and to step 628 if it is not zero. At step 629, the timer A is stopped and cleared before going to step 630.

Figure 20:
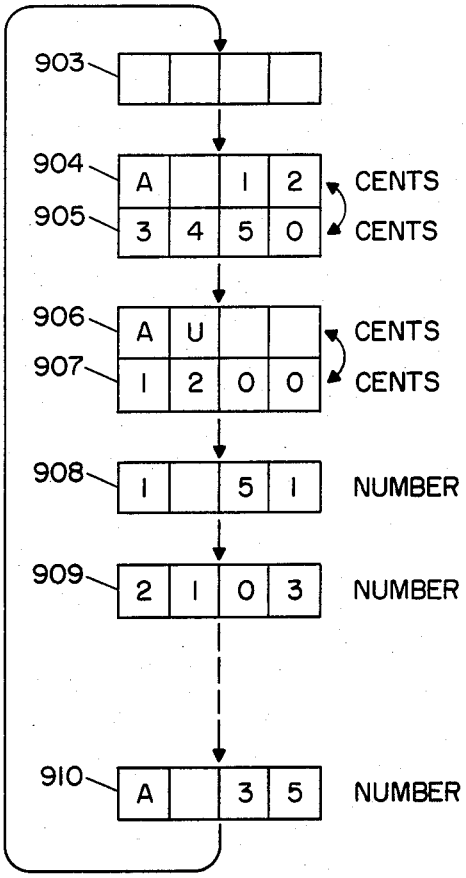

Depending on the value of the column memory, at steps 630–639, the value of the gross sales sum memory 804 in the BCD 5 digit by 10 money unit is displayed on the LED 11 by switching at a predetermined time interval (for example, 5 sec) as shown by 904, 905 in FIG. 20 (where "A" represents the gross sales sum showing that the sum is 123450 money units) if the value is "1", the value of the discounting accumulation sum memory 805 in the BCD 5 digit by 10 money unit is displayed on the LED 11 by switching in the same manner as the gross sales sum as shown by 906, 907 in Fig. 20 (where "AU" represents the discounted gross sum showing that the sum is 1200 money unit) if it is "2", the value of the No. 1 gross sales number memory 806 in the BCD 3 digit is displayed on the LED 11 as shown by 908 in FIG. 20 (where the LED 111 indicates the price column number and LEDs 112, 113, 114 represent the number) as shown by 908 in FIG. 20 if it is "3" and, in the same manner, the value for the gross sales number memories 807–808 are displayed on the LED 11 (where "A" is displayed for the No. 10 price column number) if the value of the column memories 811 if 4–12, after which the program returns to step 626.

In the case where the value of the column memory 11 is other than 1–12, the program proceeds to step 640. At step 640, the column memory 811 is cleared, and then at step 641, the number display (display on the LED 11 and the unit LED 123) displayed at the step 639 (display at the step 639 is made when reaching the step 639) is terminated after which the program returns to step 626.

As described above, the content of the gross sales is displayed by switching depending on the number of depressions of column switch 141.

12. Operation for the Failure Display Mode

Figure 12:
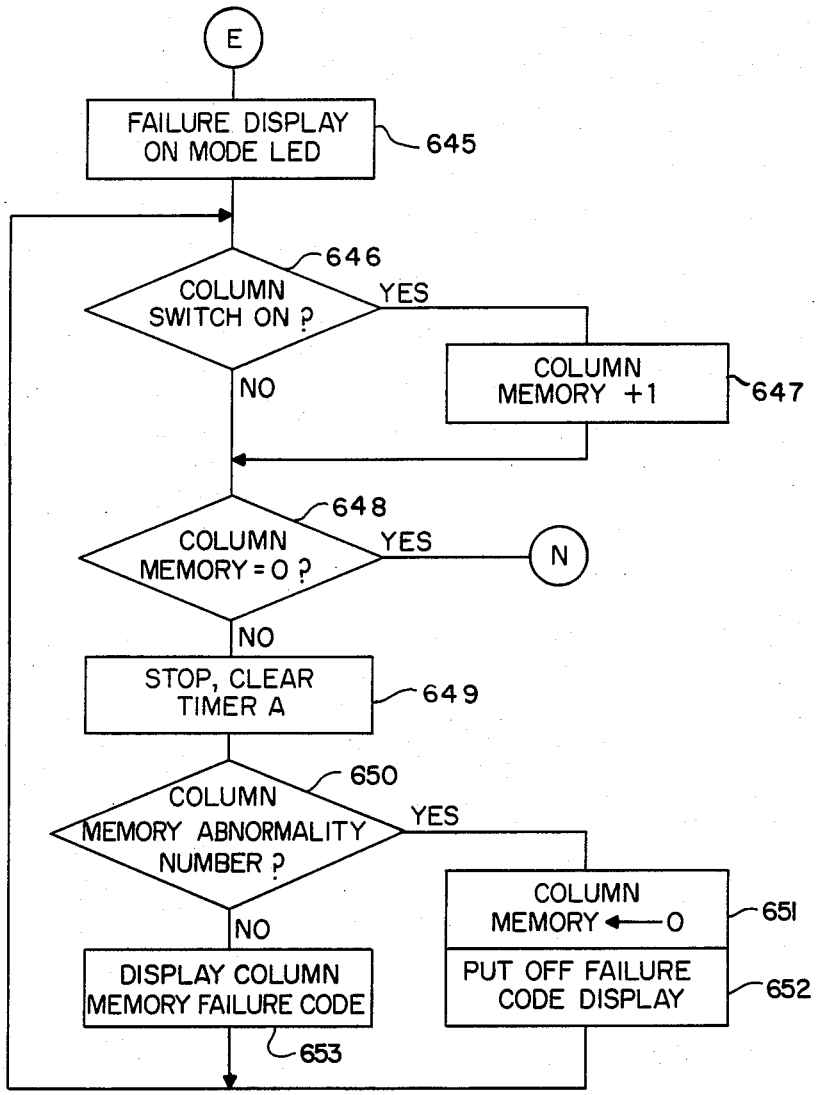

An explanation will now be made of the operation for the failure display mode, with reference to FIG. 12. At step 645, the LED 133 is lit to indicate that the mode is in the failure display mode before going to step 646. The program goes to step 647 from step 646 if the column switch 141 is depressed, and to step 648 otherwise. At step 647, "1" is added to the value of the column memory 811, and at step 648, it is determined whether the value of the column memory 811 is zero or not and the program goes to step 726 in Fig. 16 if it is zero and to step 649 if it is not zero. At step 649, the timer A is stopped and cleared. Then at step 650, the number of abnormalities stored for each kind of the failure in the abnormal flag memory 809 is counted and compared with the value of the column memory 811, and the program goes to step 651 if the value of the column memory 811 is greater than the number of abnormalities, and to step 653 if it is not greater. At step 653, the content of the failure (abnormality) is displayed depending on the value of the column memory as shown by 913, 914, 915 in FIG. 21, after which the program returns to step 653. At step 651, the column memory 811 is cleared, and at step 652, the failure code display initiated at step 653 is terminated before the program returns to step 646.

Figure 21:
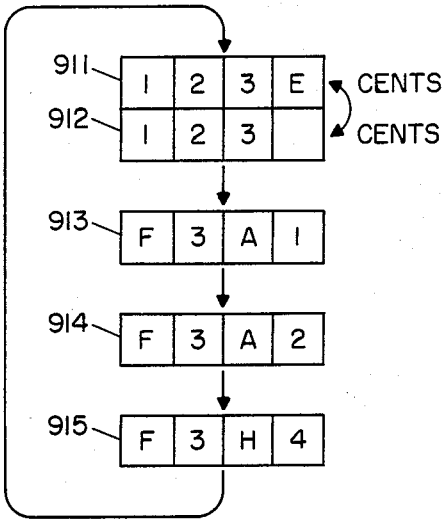

In FIG. 21, displays 911 and 912 are in the same state as in FIG. 19 and are intermittent to indicate that an abnormality is present at the step 506 in FIG. 4. Then, after depressing the mode switch 146 to establish the failure display mode, and upon depressing the column switch 141 once, the display becomes as shown by 913 in FIG. 21 in the case where there are three abnormalities. Display 913 represents, by "F3", the presence of three abnormalities, and "Al" is a failure code indicating the type of the abnormality (failure) (for instance showing that the 10 unit coin signal has been left as inputted upon abnormality check at step 532 in FIG. 6). Then, upon depressing the column switch 141 again, the failure code "A2" (for instance showing that the 50 unit coin signal has been left as inputted) is displayed as shown by 914, and upon depressing the column switch 141 once again, the failure code "H4" (for instance, indicating that the change discharge motor is locked) is displayed as shown by 915 and then, depressing the column switch 141 once again it returns the display at 911, 912. That is, failure codes are displayed in sequence upon every depression of the column switch 141.

In the above embodiment, since timers A, B, C and D do not simultaneously perform the counting operation, only one timer is needed. Further, the timer can be constituted with ease by employing the timer interrupt function of a microcomputer. Specifically, the timer interruption is generated at a predetermined time interval (for example, 2 msec) and the number of the timer interruptions may be counted and stored in RAM. Furthermore, although the LEDS 11, 12 and 13 as the display means have been explained with respect to the static lighting system, a dynamic lighting system can of course be used. Specifically, they may be lit on every 7 (or lesser) segments collectively in the order of the LEDs 111, 112, 113, 113, 123. The above-mentioned timer interruption can conveniently be employed therefor.

Referring to the selling price setting mode or the like, although it does not automatically return to the mode 0 even if the switch (column switch, setting switch or data switch) is not operated within a predetermined of time after depressing the column switch or the setting switch, it may be adapted to return automatically to the mode 0 if no switch operation is made within a predetermined of time. Further, memories for accumulating gross sales such as a gross sales sum memory may be cleared in the case where the gross sales sum display is continued for a predetermined of time (for example, 1 min), or the abnormal flag memory may be cleared in the case where the failure code display is continued for a predetermined of time Further, referring to the gross sales display mode, if the setting for the discounting sum is zero or if the value of the discounted accumulation sum memory is zero in the case of display by the depression of the column switch, the display for the gross sales number for the price column can be jumped and automatically proceed to the next display if the set price is zero or the value of the gross sales number memory is zero. Further, in the case where no abnormality is stored in the abnormal flag memory, the failure display mode can be jumped to automatically transfer to the next mode when selecting the mode by the depression of the mode switch. Furthermore, referring to the setting mode, although it is adapted to set by the dispression of the setting switch, it may be set by the depression of the column switch.

In addition, although all of the data are always stored for control in the non-volatile memories in the above embodiment, the gross sales sum or the like may be stored for control in RAM not backed-up with an electric cell or the like during normal power supply and necessary data can be put into the non-volatile memories for protection upon interruption of the power supply.

Further, although the commodity dispense is not controlled by the coin meck in the above embodiment, the control device can be constituted with ease so as to control the entire automatic vending machine including the control for the commodity dispense.

As described above, according to this invention, since the mode is switched and displayed by the number of depressions of only one mode switch, the setting price column or the like is switched and displayed at a predetermined mode by the depression number for one column switch and the change of the data to be set is stepped and displayed for each of the digits independently by the depression of the data switch, it requires only a small number (i.e., six in the illustrated and described embodiment) of switches (while 16 or more keys including function keys are required in the case of using ten keys) and display means for the display of the mode, which enables to reduce the size, thereby making it possible to mount at the front of the coin meck and direct operation on the front for the price setting.

Furthermore, since the gross sales or the like have hitherto been indicated on the display means for confirming the customer of the deposited sum of money, the positions between the switch operated for the display of the gross sales or the like (mounted on the coin meck) and the display means (mounted on the automatic vending machine main body) are different, thus making it difficult to confirm the gross sales or the like, whereas according to the invention since display means are integrally disposed to the operation switch independently from the display means for confirming the customer of the deposited sum of money, confirmation for the gross sales or the like can be faciliated. In addition, separate provision of the display means does not increase the cost since this display means may be used also for the setting of the selling price or the like.

From the foregoing, it will be observed that numerous variations and modifications may be effected without departing from the true spirit and scope of the novel concept of the invention. It is to be understood that no limitation with respect to the specific embodiment illustrated here is intended or should be inferred. It is, of course, intended to cover by the appended claims all such modifications as fall within the scope of the claims.

What is claimed is:

1. A control device for an automatic vending machine for a plurality of different commodities wherein a common display is used for displaying parameter values relating to each of a plurality of machine operating and display modes, comprising:

an operation panel disposed on a front face of a coin mechanism and provided with data display means having a plurality of digits, mode display means for indicating which operating and display mode the machine is in, a column switch, a data advance switch for each of said plurality of digits, a setting switch, and a mode selection switch;

a price memory for storing a selling price for each of said plurality of commodities;

an amount-sold memory for storing an amount sold for each of said plurality of commodities;

mode selection control means for selecting the mode of operation of the machine and of the data display means between at least an ordinary selling mode, a price setting (selling price) mode, a change recovery mode, and an amount-sold (gross sale) display mode, by automatically cycling through said modes in sequence in response to actuations of said mode selection switch, and further including timer means for returning the machine to the ordinary selling mode in response to the mode selection switch not being actuated for a predetermined time period;

mode display control means for causing said mode display means to indicate the present operational mode of the machine and of the data display means as selected by said mode selection control means;

price setting control means for designating, in said price setting mode, one of said plurality of commodities by automatically cycling through said commodities incrementally in response to actuations of said column switch so as to cause said data display means to display information indicating the identity of the designated commodity and the associated selling price of said commodity stored in said price memory, and to cause each digit of the price display to advance incrementally substantially one unit at a time in response to each actuation of said data switch associated with said digit, and to further cause said price memory for the designated commodity to store the displayed price when said setting switch is operated;

change recovery control means for designating, in said change recovery mode, one of a plurality of change cylinders which store respective different denominations of coins so as to cause said data display means to display the identity of a designated change cylinder and to discharge all of the coins in the designated change cylinder when said setting switch is operated;

amount-sold display control means for designating, in said amount-sold display mode, one of said plurality of commodities by automatically cycling through said commodities incrementally in response to actuations of said column switch so as to cause said data display means to display information indicating the identity of the designated commodity and the amount-sold of said associated commodity stored in said amount-sold memory; and selling control means for performing, in said ordinary selling mode, a selling operation of a commodity selected by a customer in response to deposit of coins in said coin mechanism at least equal to the selling price of said selected commodity stored in said price memory and causing said amount-sold memory to update the amount sold of said selected commodity in said selling operation.

* * * * *